US008111020B2

(12) United States Patent
Furukawa et al.

(10) Patent No.: US 8,111,020 B2
(45) **Date of Patent: *Feb. 7, 2012**

(54) APPARATUS AND METHOD FOR DRIVING BACKLIGHT UNIT

(75) Inventors: Norimasa Furukawa, Tokyo (JP); Hiroaki Ichikawa, Kanagawa (JP); Kenichi Kikuchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/656,268

(22) Filed: Jan. 22, 2010

(65) Prior Publication Data

US 2010/0181921 A1 Jul. 22, 2010

Related U.S. Application Data

(63) Continuation of application No. 10/571,278, filed as application No. PCT/JP2005/012686 on Jul. 8, 2005, now Pat. No. 7,675,249.

(30) Foreign Application Priority Data

Jul. 12, 2004 (JP) ..... 2004-205146
Nov. 19, 2004 (JP) ..... 2004-336373

(51) Int. Cl.
*H05B 37/02* (2006.01)
*G09G 3/36* (2006.01)

(52) U.S. Cl. ..... 315/309; 315/149; 315/308; 345/102

(58) Field of Classification Search ..... 315/149, 315/152–153, 155–158, 246, 250, 291, 307–309, 315/312; 345/72, 82–85, 88–89, 102, 204, 345/690

See application file for complete search history.

(56) References Cited

U.S. PATENT DOCUMENTS 6,127,784 A * 10/2000 Grossman et al. ..... 315/159
(Continued)

FOREIGN PATENT DOCUMENTS

JP 2002-116481 4/2002
(Continued)

OTHER PUBLICATIONS

Zack R., "Color Stabilization of RGB LEDs in an LED Backlighting Example"; Jan. 15, 2004; retrieved from: URL:http//catalog.osram-os.com/media/_enGraphics/00017070_0.pdf. (8 pages).

*Primary Examiner* — Tung X Le
(74) *Attorney, Agent, or Firm* — Finnegan, Henderson, Farabow, Garrett & Dunner, L.L.P.

(57) ABSTRACT

The present invention is directed to a drive apparatus for a backlight unit (20) in which plural LED (Light Emitting Diode) elements are cascade-connected every three primary colors, which comprises a signal generating unit (44) for generating a signal having an arbitrary amplitude, an adjustment unit (50) for adjusting light emission quantities of groups of LED elements (30) on the basis of the signal which has been generated by the signal generating unit (44), a voltage applying unit (41) for applying a predetermined voltage every the groups of LED elements (30), light emission quantity detecting units (33) for detecting quantities of rays of light which have been emitted from the groups of LED elements (30), calorific value detecting units (32) for detecting calorific values emitted from the groups of LED elements in accordance with the voltage which has been applied to the voltage applying unit (41), and a control unit (50) for controlling the signal generating unit (44) on the basis of light emission quantities which have been detected by the light emission quantity detecting units (33) and calorific values which have been detected by the calorific value detecting units (32).

10 Claims, 20 Drawing Sheets

U.S. PATENT DOCUMENTS

| | | | | |
|---|---|---|---|---|
| 6,411,046 | B1 * | 6/2002 | Muthu | 315/309 |
| 6,441,558 | B1 | 8/2002 | Muthu et al. | |
| 6,914,387 | B2 * | 7/2005 | Sato et al. | 315/169.1 |
| 7,026,769 | B2 * | 4/2006 | Lee et al. | 315/291 |
| 7,183,727 | B2 | 2/2007 | Ferguson et al. | |
| 7,262,752 | B2 * | 8/2007 | Weindorf | 345/82 |
| 7,391,172 | B2 * | 6/2008 | Ferguson et al. | 315/308 |
| 7,432,668 | B2 * | 10/2008 | Zwanenburg et al. | 315/312 |
| 2002/0070914 | A1 | 6/2002 | Bruning et al. | |
| 2002/0097000 | A1 | 7/2002 | Muthu et al. | |
| 2002/0175632 | A1 * | 11/2002 | Takeguchi | 315/169.1 |
| 2003/0214242 | A1 * | 11/2003 | Berg-johansen | 315/169.3 |
| 2003/0230991 | A1 | 12/2003 | Muthu et al. | |
| 2004/0105264 | A1 | 6/2004 | Spero | |
| 2004/0160192 | A1 | 8/2004 | Nakano | |
| 2005/0057580 | A1 | 3/2005 | Yamano et al. | |
| 2007/0132398 | A1 | 6/2007 | Ferguson et al. | |

FOREIGN PATENT DOCUMENTS

| | | |
|---|---|---|
| JP | 2002-314136 | 10/2002 |
| JP | 2003-132708 | 5/2003 |
| JP | 2003-188415 | 7/2003 |
| JP | 2003-255914 | 9/2003 |
| JP | 2003-297123 | 10/2003 |
| JP | 2004-134804 | 4/2004 |
| JP | 2004-515891 | 5/2004 |
| JP | 2004-517444 | 6/2004 |
| JP | 2004-184852 | 7/2004 |
| WO | WO 02/47438 | 6/2002 |
| WO | WO 02/052901 | 7/2002 |
| WO | WO 02/080625 A1 | 10/2002 |
| WO | WO 03/037042 A1 | 5/2003 |

* cited by examiner

APPARATUS AND METHOD FOR DRIVING BACKLIGHT UNIT

This Application is a continuation of application Ser. No. 10/571,278, filed on Mar. 9, 2006, now U.S. Pat. No. 7,675, 249, currently allowed, which is a national stage filing under 35 U.S.C. §371 of PCT/JP2005/012686, filed on Jul. 8, 2005, and claims priority of Japanese Patent Application No. 2004-205146, filed on Jul. 12, 2004, and Japanese Patent Application No. 2004-336373, filed on Nov. 19, 2004, all of which are incorporated herein by reference in their entirety.

TECHNICAL FIELD

The present invention relates to a drive apparatus and a drive method which are adapted for performing drive control of a backlight unit comprised of groups of LED elements.

BACKGROUND ART

In display devices using LED (Light Emitting Diode) elements as display pixels, in order to perform matrix drive operation of the LED elements, X-Y addressing drive circuits are required for respective pixels. The display device serves to perform selection (addressing) of a LED element located at the position of pixel desired to be emitted (lighted) by addressing drive circuit to modulate lighting time by, e.g., PWM (Pulse Width Modulation) drive system to execute luminance adjustment to obtain display picture having a predetermined gradation.

However, when drive circuits are assembled with respect to individual LEDs, in the case where the number of LEDs is large, the circuit configuration becomes complicated so that cost is increased.

On the other hand, it is proposed and studied to use LED elements as backlight light source for liquid crystal display. Particularly, since a method in which LED elements of respective primary colors of red (R), green (G) and blue (B) are individually used to optically perform synthetic additive color mixture to obtain white light can easily take color balance, such a method is extensively studied as display device of television image receiver.

Meanwhile, LEDs individually have unevennesses of luminance values. When attempt is made to correct those individual unevennesses, respective individual elements must be necessarily driven, one by one, by independent drive circuits. As a result, drive form extremely becomes similar to that of the matrix type drive system corresponding to the previously described display device using LED elements as display pixels. Namely, in the case where the number of LED elements is large, drive circuit by addressing would become complicated.

Moreover, in the case where, e.g., LED elements are used, as light source, for backlight of liquid crystal display device, since light emission coefficients of LED elements of respective primary colors of red (R), green (G) and blue (B) are different from each other, it is necessary to also adjust, every colors, currents to be applied to LED elements of respective colors. Further, in the LED elements, since semiconductor compositions are different from each other every respective colors, voltages and power consumptions of elements are different from each other every respective colors.

In addition, in actual circuits having large powers of respective LED elements and used in LED drive operation for illumination purpose, since LSI, etc. for large power drive is not yet prepared, the cost is increased in the matrix type drive system so that it is economically disadvantageous.

In view of the above, there is proposed a method in which connection form of LED elements is used as cascade connection form in order that the circuit scale is not caused to be large. In the cascade connection form, PWM adjustment of currents in a certain series of LED connection groups, e.g., groups in which LED elements of red, green and blue are connected every respective colors is performed to adjust color tone and luminance based on synthesis of rays of light emitted from LED elements of red, green and blue.

In the backlight unit in which the cascade connection form is employed as connection form of LED elements, a DC-DC converter power supply unit for delivering a predetermined voltage every groups of red, green and blue LED elements which are cascade-connected is provided, and a LED-PWM control unit is provided at the load side.

Meanwhile, in the configuration as described above, since temperature dependencies of light emission outputs of respective color systems are also different and temperature characteristics are not uniform, it is necessary to perform adjustment of pulse width every colors by drive circuits dedicated for respective colors.

For example, under the situations where temperature is not completely elevated immediately after lighting of the backlight, the LED element of red having high light emission efficiency is emitted in a time of about 50% of ON time of drive pulse width of PWM signal, whereas the LED element having low light emission efficiency is emitted in a time of about 80~90% of ON time of drive pulse width of PWM signal.

Since rays of light emitted from LED elements have such property, it is necessary for keeping constant color tone (color temperature and chromaticity) and luminance of white light obtained by synthesis of rays of light emitted from LED elements of red, green and blue to detect, by photo-sensors, rays of light which are respectively emitted from LED elements of red, green and blue to execute feedback servo so that the value thus detected becomes constant.

In such feedback system, e.g., in the case where resolution of change of pulse width for controlling PWM signal is coarse, there would result difference of adjustment accuracy such that, in dependency upon the number of divisions between 0% and 100%, change width becomes coarse in the case of the LED element of red having good (high) light emission efficiency, whereas change width becomes fine in the case of the LED element of blue having bad (low light emission efficiency)

Further, since colors of rays of light emitted from the LED elements have uneven accuracies every respective colors by differences of resolutions of respective color systems, adjustment of balance of RGB and/or adjustment of white light become difficult.

In addition, even if the above-described problems can be all solved, not only light emission output but also light emission spectrum distribution of LED elements of respective colors would change by temperature change in the LED elements of respective colors so that light emission chromaticities of respective colors change. Accordingly, in the case where there is only employed a method of detecting light quantities of LED elements of respective colors by the photo-sensors, it is impossible to correct change of color tone. In the case where the backlight unit has temperature distribution, e.g., in upper and lower directions with drive operation thereof, color unevenness based on difference of that temperature would take place. As stated above, by performance of the photo-sensor and/or temperature characteristic of light emission distribution of LED elements, it is a limit to maintain accuracy such that chromaticity control deviation is about $\Delta x \approx 0.002$ and $\Delta y \approx 0.002$.

DISCLOSURE OF THE INVENTION

Problems to be Solved by the Invention

The present invention has been proposed in view of the problems that prior arts as described above have, and its object is to provide a drive apparatus and a drive method for backlight unit which are adapted for controlling a drive unit for emitting groups of LED elements on the basis of light emission quantities and calorific value or values of the groups of LED elements constituting the backlight unit.

The drive apparatus according to the present invention is directed to a drive apparatus for backlight unit comprised of groups of LED (Light Emitting Diode) elements in which the LED elements are cascade-connected every three primary colors, which comprises: signal generating means for generating a signal having an arbitrary amplitude; adjustment means for adjusting light emission quantities of the groups of the LED elements on the basis of the signal which has been generated by the signal generating means; voltage applying means for applying a predetermined voltage every the groups of LED elements; light emission quantity detecting means for detecting quantities of rays of light which are emitted from the groups of the LED elements in accordance with the voltage which has been applied by the voltage applying means; temperature detecting means for detecting temperature or temperatures of the groups of the LED elements; and control means for controlling the signal generating means on the basis of the light emission quantities which have been detected by the light emission quantity detecting means and the temperature or temperatures which has or have been detected by the temperature detecting means.

Moreover, the drive method according to the present invention is a drive method for a backlight unit comprised of groups of LED (Light Emitting Diode) elements in which LED elements are cascade-connected every three primary colors, which comprises: a voltage application step of applying a predetermined voltage every the groups of LED elements; a light emission quantity detection step of detecting light quantities emitted from the groups of LED elements in accordance with the voltage which has been applied by the voltage application step; a temperature detection step of detecting temperature or temperatures of the groups of the LED elements; a signal generation step of generating a signal having an arbitrary amplitude on the basis of the temperature or temperatures which has or have been detected by the temperature detection step; and an adjustment step of adjusting light emission quantities of the groups of the LED elements on the basis of the signal which has been generated by the signal generation step.

In the drive apparatus and the drive method according to the present invention, in a system of driving LED elements used as the liquid crystal backlight, detection result of the photo-sensor relating to an arbitrary color is caused to be reference to monitor other colors to perform feedback of relative percentage (ratio), and to change the ratio subject to feedback on the basis of detection results of the temperature sensors, thus making it possible to perform extremely uniform control.

Still further objects of the present invention and merits obtained by the present invention will become more apparent from the embodiments which will be given below with reference to the attached drawings.

BEST MODE FOR CARRYING OUT THE INVENTION

Embodiments of the present invention will be explained in detail with reference to the attached drawings.

Figure 1:
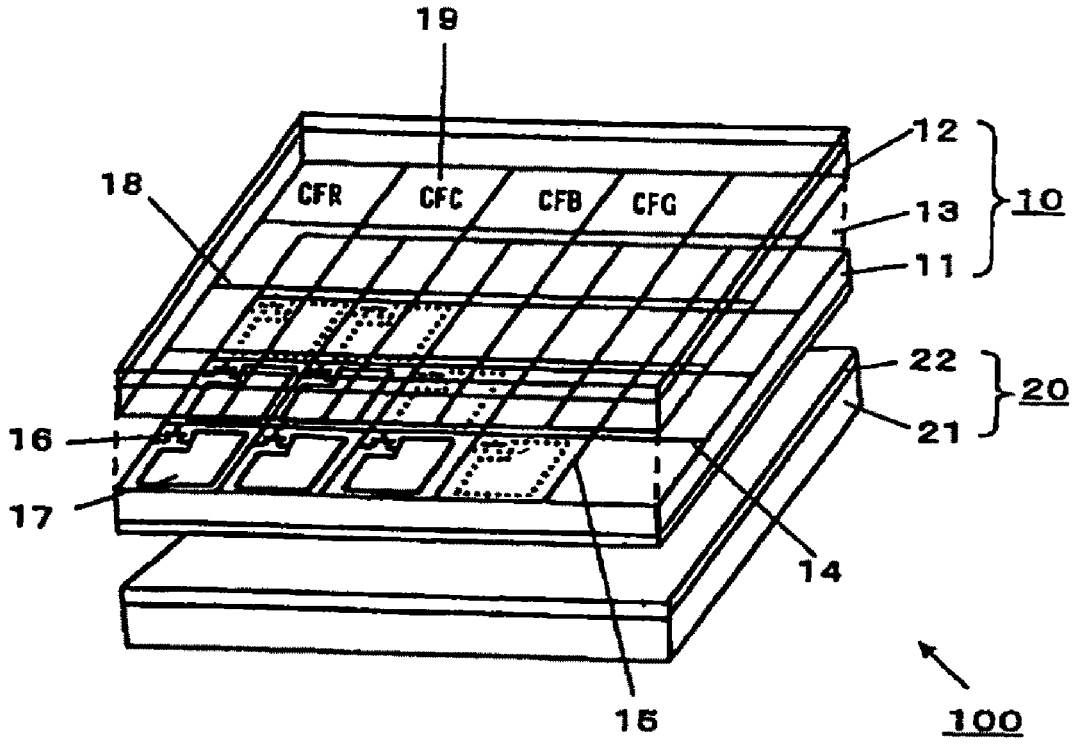
FIG. 1 is a perspective view showing, in a model form, a color liquid crystal display apparatus of the backlight system to which the present invention is applied.

The present invention is applied to, e.g., a color liquid crystal display apparatus 100 of the backlight system of the configuration as shown in FIG. 1.

The color liquid crystal apparatus 100 shown in FIG. 1 comprises the transmission type color liquid crystal display panel 10, and a backlight unit 20 provided at the rear face side of the color liquid crystal display panel 10.

The transmission type color liquid crystal display panel 10 has the configuration in which a TFT base (substrate) 11 and an opposite electrode base (substrate) 12 are arranged opposite to each other, and a liquid crystal layer 13 in which, e.g., twisted nematic (TN) liquid crystal is filled is provided at the spacing therebetween. On the TFT base 11, there are formed signal lines 14 and scanning lines 15 which are arranged in a matrix form, and thin film transistors 16 as switching elements and pixel electrodes 17 which are arranged at intersecting points thereof. The thin film transistors 16 are sequentially selected by the scanning lines 15, and serve to write video signals delivered from the signal lines 14 into corresponding pixel electrodes 17. On the other hand, opposite electrodes 18 and color filters 19 are formed at the internal surface of the opposite electrode base 12.

The color liquid crystal display apparatus 100 is adapted so that the transmission type color liquid crystal display panel 10 of such a configuration is put between two polarization plates to perform drive operation by the active matrix system in the state where white light is irradiated from the rear face side by the backlight unit 20 so that a desired full color image display can be obtained.

The backlight unit 20 comprises a light source 21 and a waveform length selection filter 22. The backlight unit 20 serves to irradiate rays of light which have been emitted from the light source 21 to illuminate the color liquid crystal display panel 10 through the wavelength selection filter 22 from the rear face side thereof.

Figure 2:
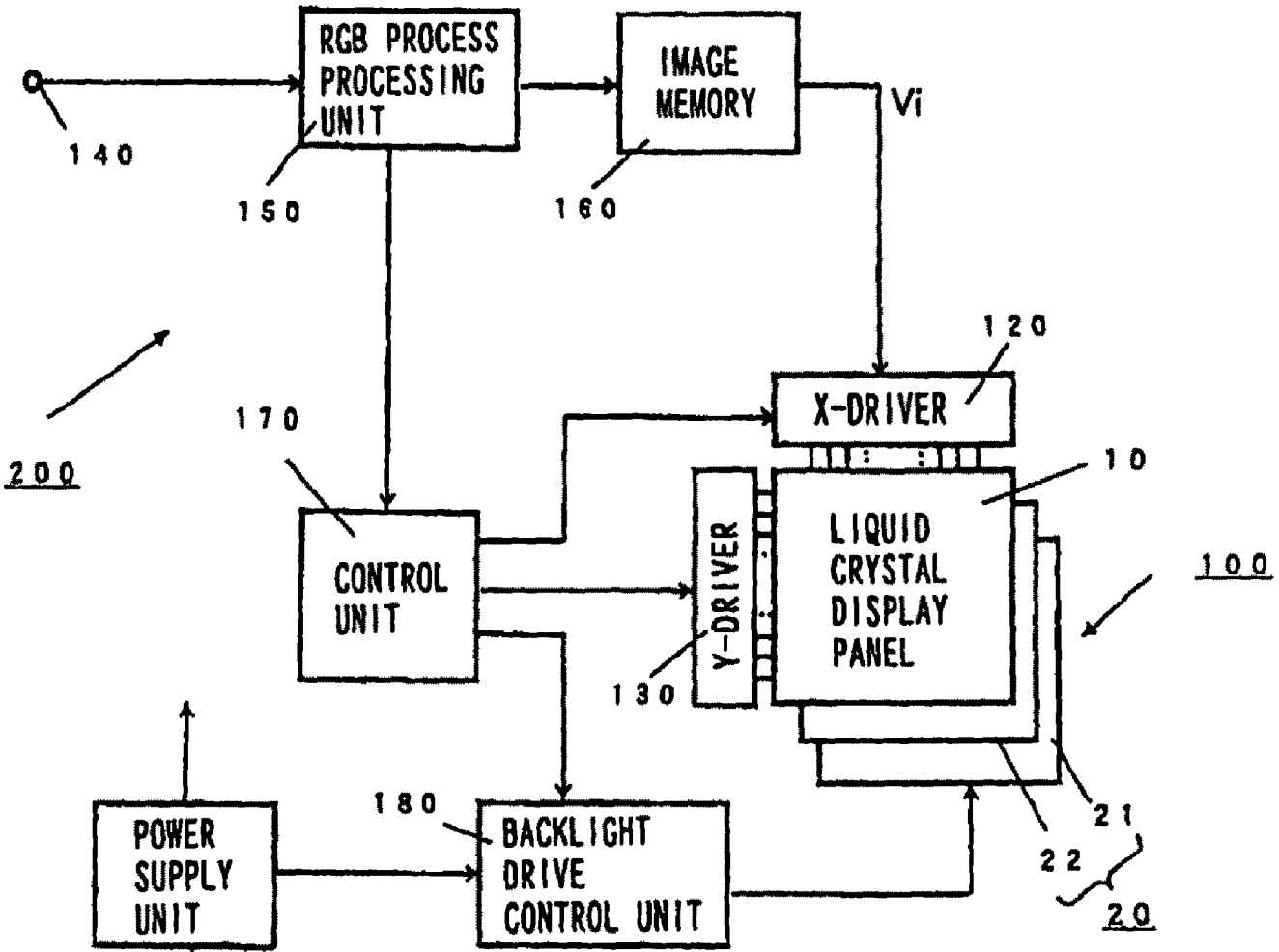
FIG. 2 is a block diagram showing a drive circuit of the color liquid crystal display apparatus.

The color liquid crystal display apparatus 100 to which the present invention is applied is driven by, e.g., a drive circuit 200 of which electric block configuration is shown in FIG. 2.

The drive circuit 200 comprises a power supply unit 110 for delivering drive powers of the color liquid crystal display panel 10 and the backlight unit 20, an X-driver circuit 120 and a Y-driver circuit 130 which are adapted for driving the color liquid crystal display panel 10, a RGB process processing unit 150 supplied with a video signal through an input terminal 140 from the external, an image memory 160 and a control unit 170 which are connected to the RGB process processing unit 150, and a backlight drive control unit 180 for performing drive control of the backlight unit 20.

In the drive circuit 200, video signal Vi which has been inputted through the internal terminal 140 is caused to undergo signal processing such as chroma processing, etc. by the RGB process processing unit 150. Further, the video signal Vi thus processed is converted from composite signal into RGB separate signal suitable for drive operation of the color liquid crystal display panel 10. The RGB separate signal thus obtained is delivered to the control unit 170 and is delivered to the X-driver 120 through the image memory 160. Moreover, the control unit 170 controls the X-driver circuit 120 and the Y-driver circuit 130 at a predetermined timing corresponding to the RGB separate signal to drive the color liquid crystal display panel 10 by RGB separate signal delivered to the X-driver 120 through the image memory 160 to display an image corresponding to the RGB separate signal.

The backlight unit 20 is of immediately below illumination type in which the transmission type color liquid crystal display panel 10 is disposed at the rear face thereof and serves to illuminate the color liquid crystal from the portion immediately below the rear face. The light source 21 of the backlight unit 20 includes plural LEDs (Light Emitting Diodes) and uses these plural light emitting diodes as light emitting source. The plural light emitting diodes are divided into set comprised of groups of light emitting diodes, and are driven every those sets.

Then, the arrangement of light emitting diodes at the light source 21 of the backlight unit 20 will be explained.

Figure 3:
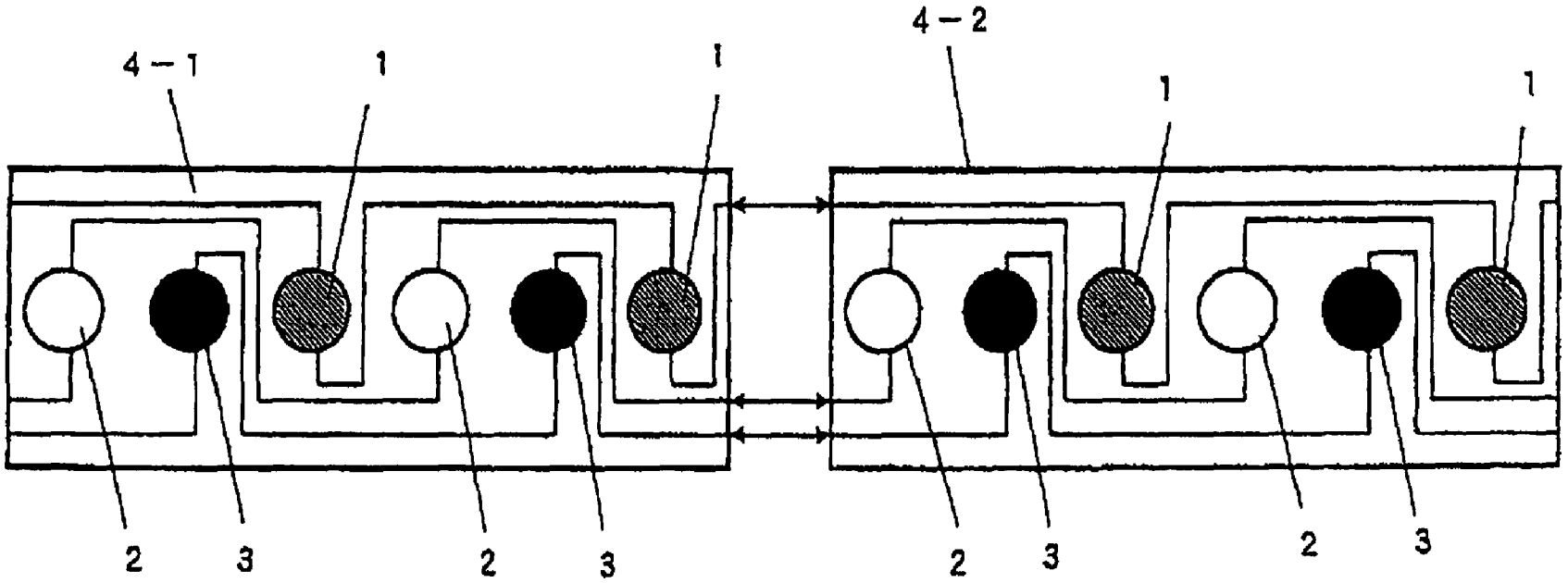
FIG. 3 is a plan view showing an arrangement example of light emitting diodes used in backlight unit constituting the color liquid crystal display apparatus.

FIG. 3 shows the state where, as arrangement example of light emitting diodes, two light emitting diodes 1 of red, two light emitting diodes 2 of green and two light emitting diodes 3 of blue are respectively used every unit cells 4-1, 4-2 so that six light emitting diodes in total are arranged in line.

While six light emitting diodes are provided as the unit cell 4 in this arrangement example, distribution of the number of respective colors may be variation except for this example from the necessity of adjusting the light output balance because mixed color is caused to be white light having good balance by rating and/or light emission efficiency of light emitting diodes used, etc.

Figure 4:
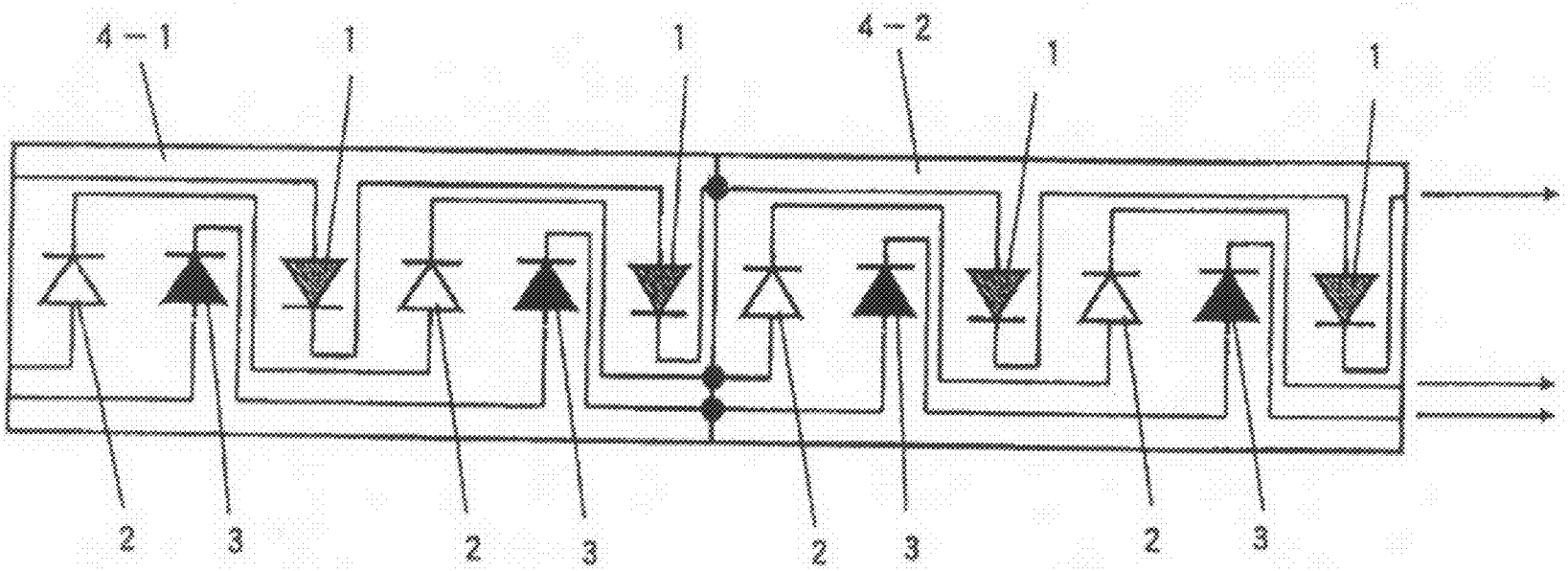
FIG. 4 is a view showing, in a model form, by diode mark of electric circuit diagram symbol, form where respective light emitting diodes are connected in the arrangement example of light emitting diodes.

In the arrangement example shown in FIG. 3, the unit cell 4-1 and the unit cell 4-2 have entirely the same configuration, and are connected at the central both end portions indicated by arrow. Moreover, FIG. 4 shows the example in which the form where the unit cell 4-1 and the unit cell 4-2 are connected is illustrated by diode mark of the electric circuit diagram symbol. In the case of this example, respective light emitting diodes, i.e., light emitting diodes 1 of red, light emitting diodes 2 of green and light emitting diodes 3 of blue are connected in series in the state where they have polarities conforming to a direction where current flows from the left to the right.

Figure 5:
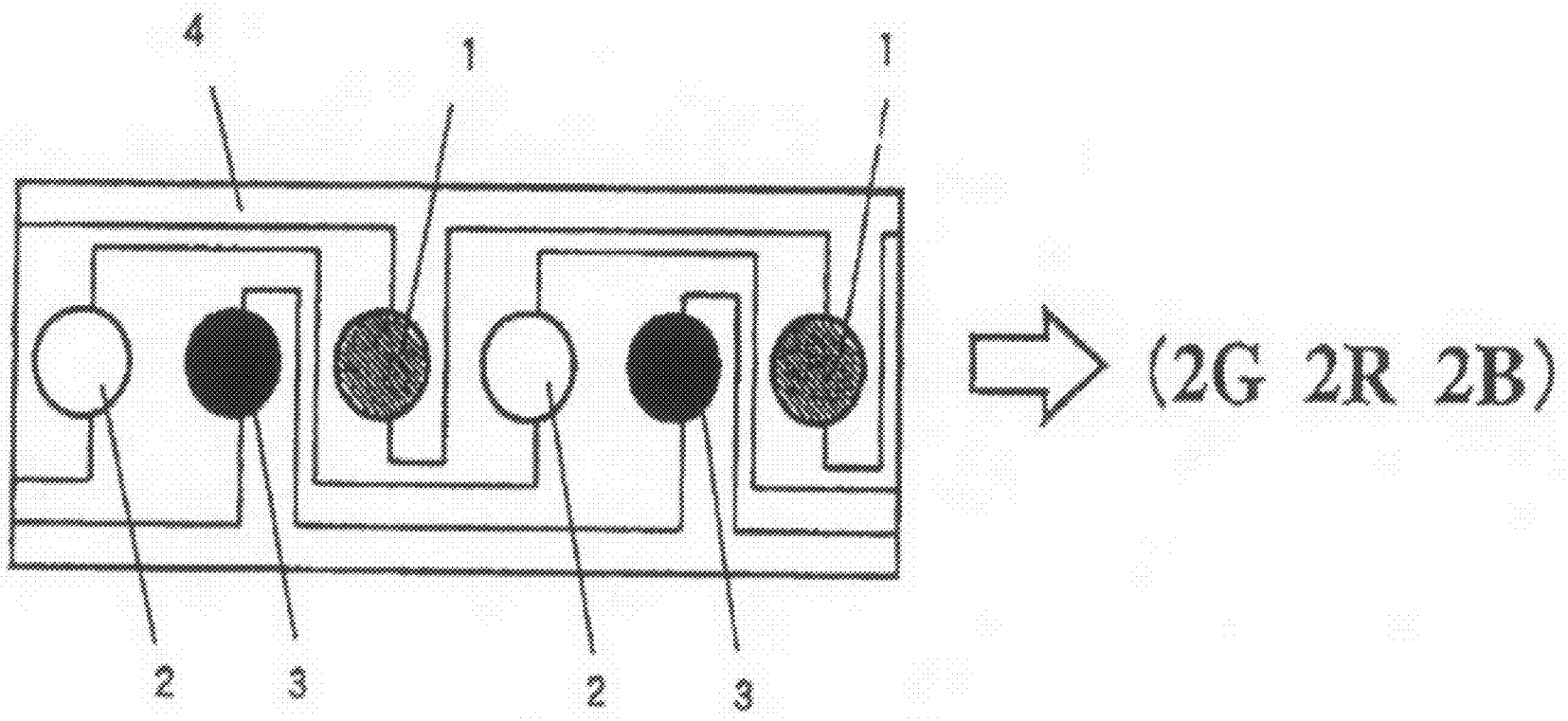
FIG. 5 is a view showing, in a model form, unit cell in which six light emitting diodes in total are arranged in line by pattern notation in terms of the number of light emitting diodes of respective colors.
Figure 6:
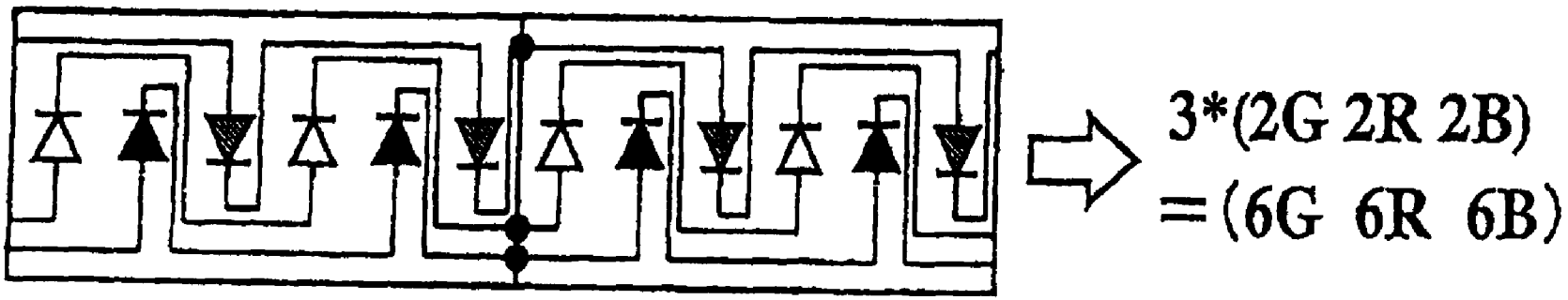
FIG. 6 is a view showing, in a model form, the case where three unit cells serving as elementary unit are successively connected by pattern notation in terms of the number of light emitting diodes.

Here, when pattern notation of unit cell 4 in which two light emitting diodes 1 of red, two light emitting diodes 2 of green and two light emitting diodes 3 of blue are respectively used so that six light emitting diodes in total are arranged in line is performed by the number of light emitting diodes of respective colors, it is represented as (2G 2R 2B) as shown in FIG. 5. Namely, (2G 2R 2B) shows that six patterns in total consisting of two patterns for green, two patterns for red and two patterns for blue are caused to be elementary unit. Further, in the case where three unit cells of elementary unit are successively connected as shown in FIG. 6, when pattern notation is performed by the number of light emitting diodes in terms of symbol expressed as 3*(2G 2R 2B), those unit cells are indicated by (6G 6R 6B).

Then, the connection relationship of light emitting diodes at the light source 21 of the backlight unit 20 will be explained.

Figure 7:
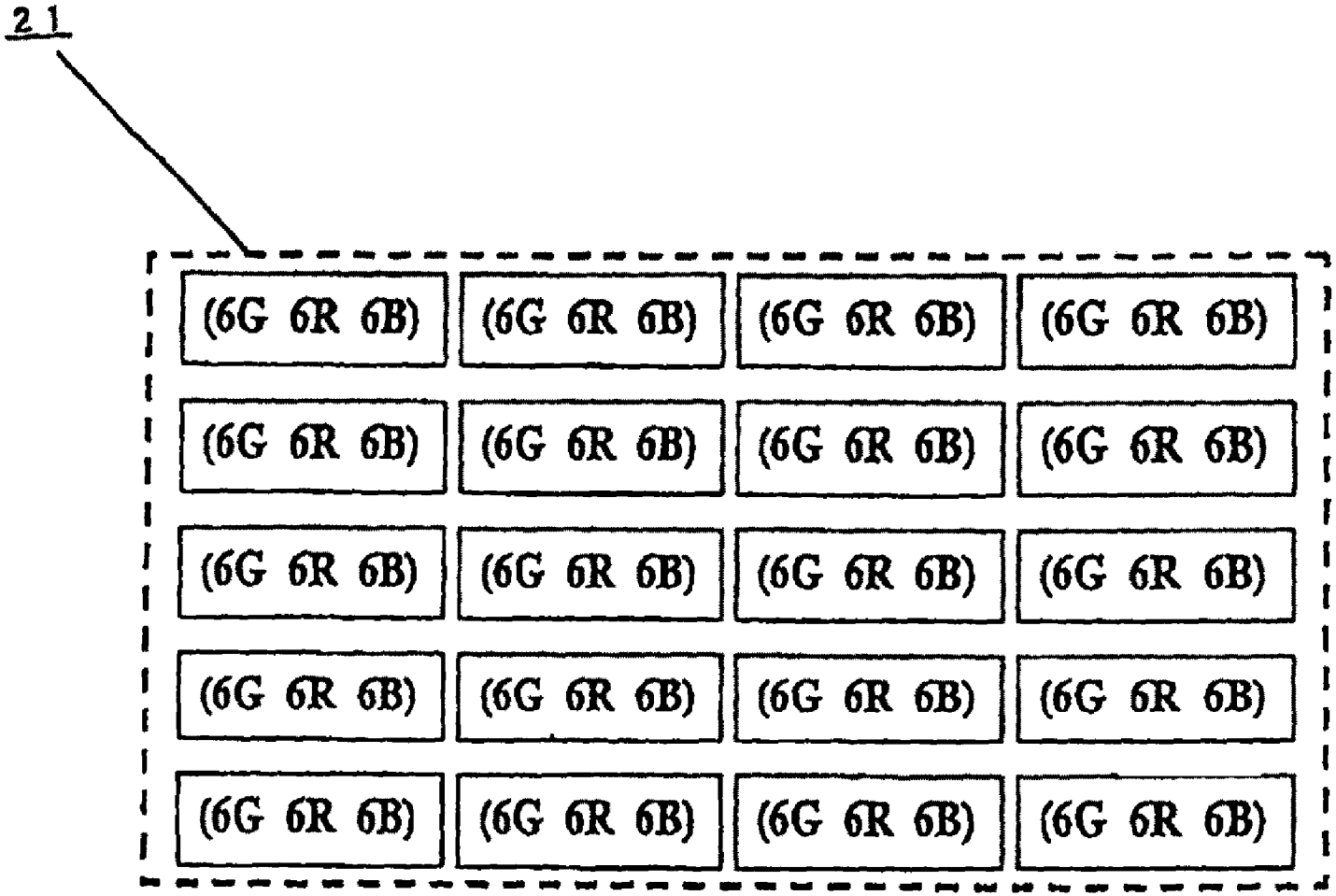
FIG. 7 is a view showing, in a model form, actual connection example of light emitting diodes constituting light source of the backlight unit.
Figure 8:
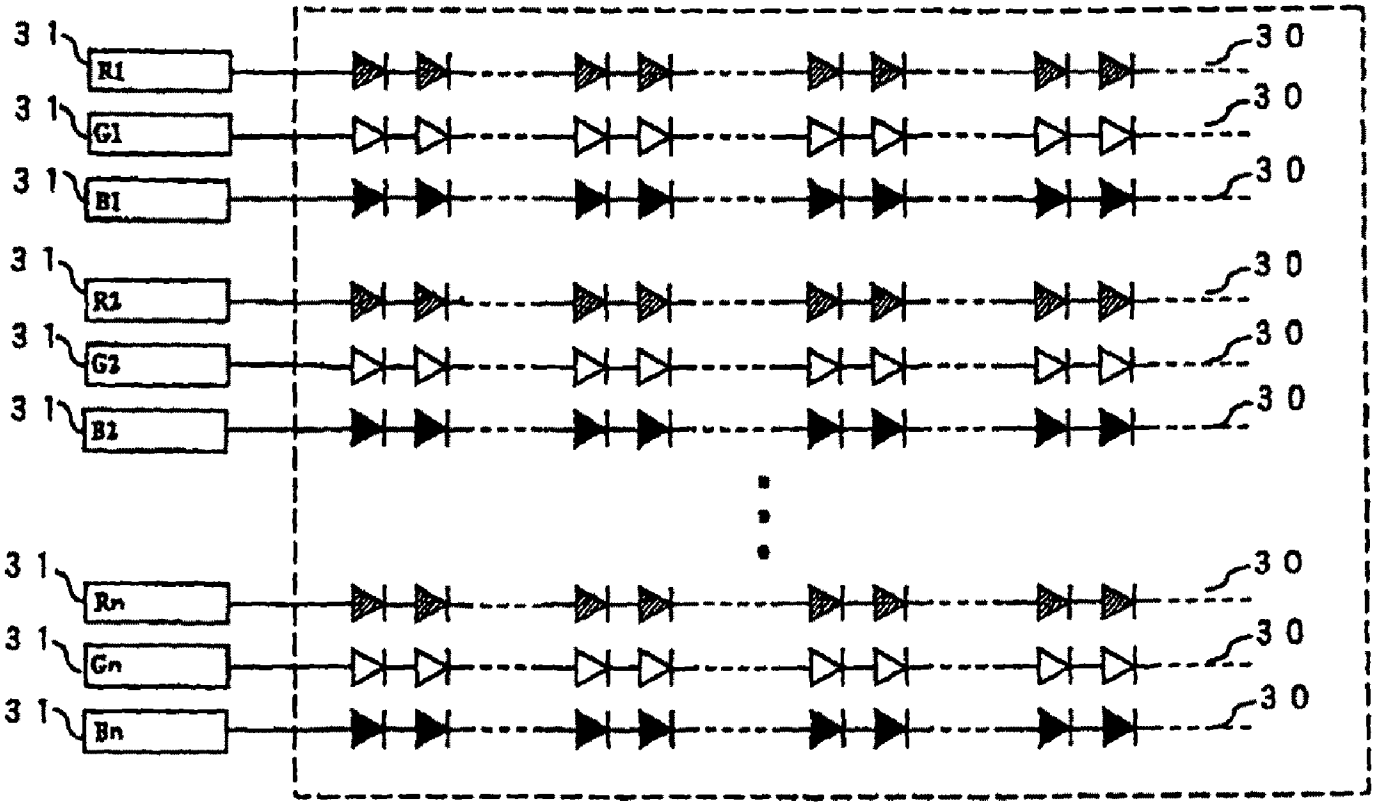
FIG. 8 is a view showing, in a model form, connection example of light emitting diodes used in the backlight unit.

As shown in FIG. 7, at the light source 21, the elementary unit which is three times larger than the previously described elementary unit (2G 2R 2B) of light emitting diodes is caused to be one middle unit (6G 6R 6B) so that the middle units (6G 6R 6B) are arranged in a matrix form having five rows in a horizontal direction and four columns in a vertical direction with respect to the screen. As a result, 360 light emitting diodes in total are arranged. These middle units (6G 6R 6B) are electrically connected in a screen horizontal direction so that light emitting diodes arranged in the screen horizontal direction. As stated above, the middle units (6G 6R 6B) are electrically connected in the screen horizontal direction are connected in series, as shown in FIG. 8, at the light source 21 of the backlight unit 20. Thus, plural groups 30 of plural light emitting diodes which are connected in series in a horizontal direction are formed.

Further, at the backlight unit 20, independent LED drive circuits 31 are respectively provided one by one at individual groups 30 of light emitting diodes which are connected in series in horizontal direction. The LED drive circuit 31 is a circuit for allowing current to flow in the group 30 of light emitting diodes to emit them.

Here, as the arrangement of the groups of light emitting diodes 30 which are connected in series in a horizontal direction, there results the state where there are connected to each other light emitting diodes arranged within the region where respective LEDs have substantially the same temperature when the temperature distribution of the backlight unit 20 is measured.

Figure 9:
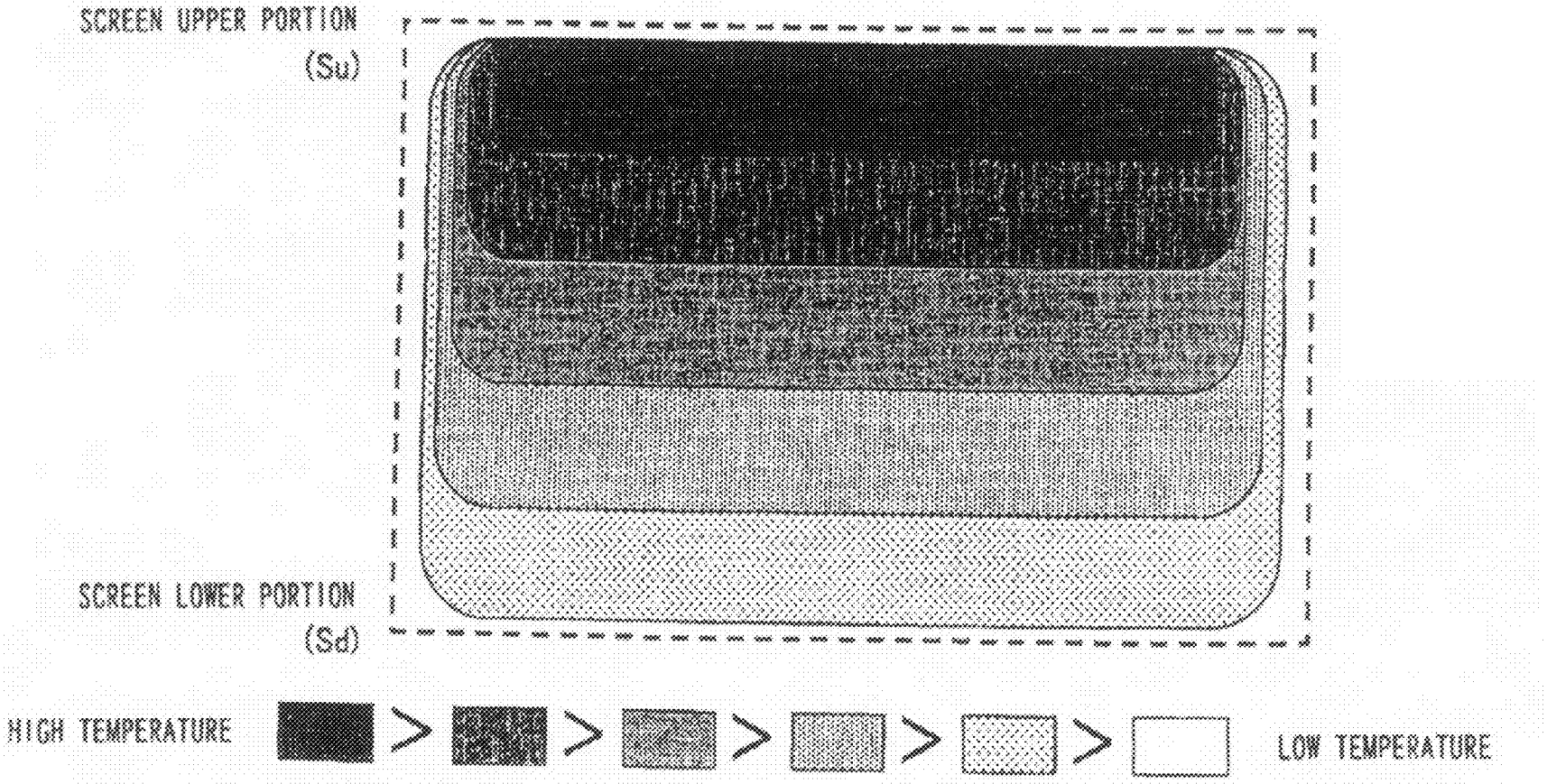
FIG. 9 is a view showing, in a model form, temperature distribution of display apparatus.

The temperature distribution example on the screen of the color liquid crystal display apparatus 100 at the time of operation of the backlight unit 20 is shown in FIG. 9. FIG. 9 shows the region where the portion in which hatching is thick has high temperature, and shows the region where the portion in which hatching is thin has low temperature. As shown in FIG. 9, in the color liquid crystal display apparatus 100, temperature becomes high according as distance from the picture upper portion Su decreases, temperature becomes higher, and the screen lower portion Sd has low temperature.

Figure 10:
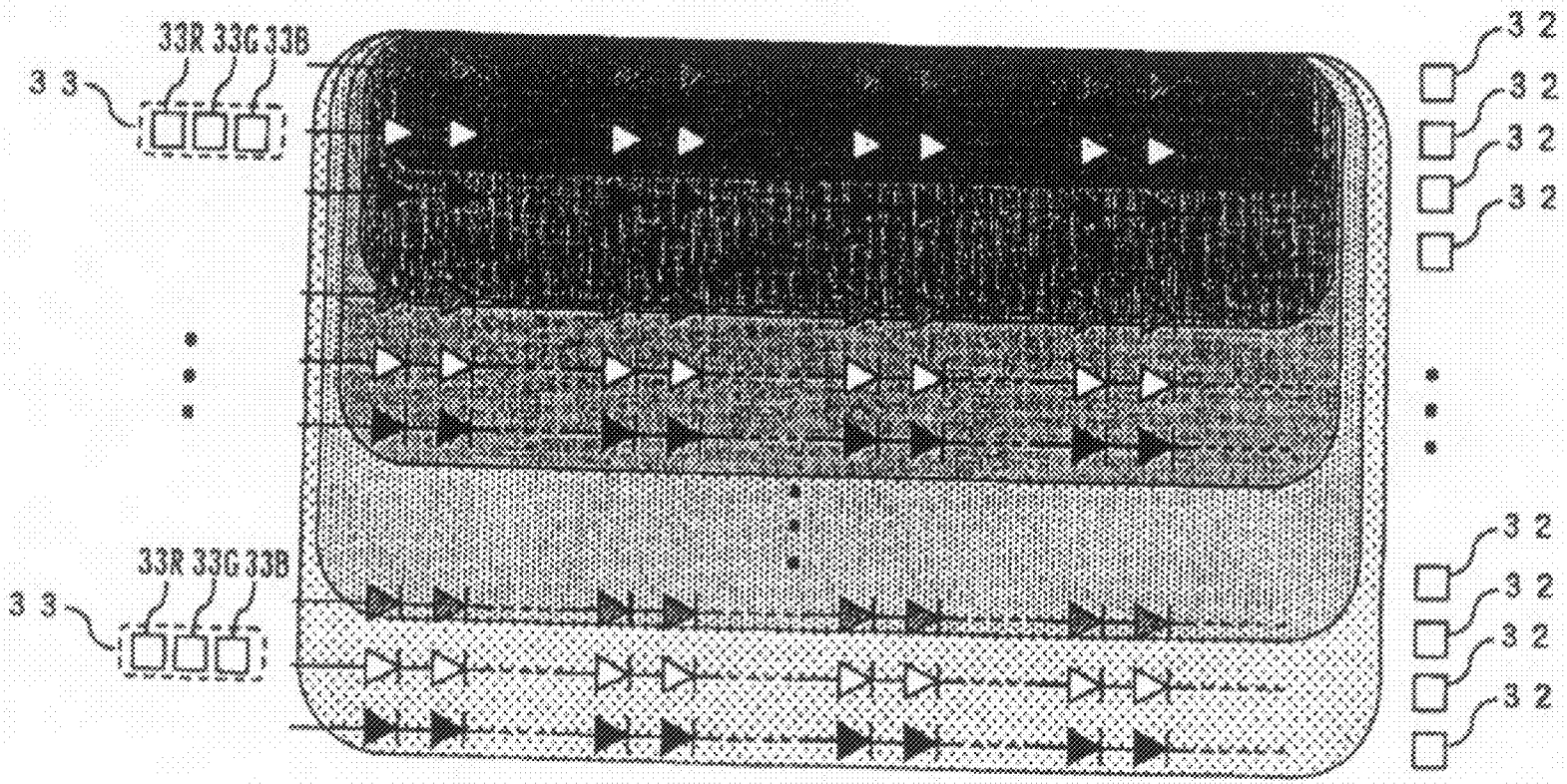
FIG. 10 is a view showing, in a model form, connection state of light emitting diodes in the backlight unit and temperature distribution of the display apparatus.

FIG. 10 is a view in which the diagram indicating the connection relationship of light emitting diodes of FIG. 8 and the temperature distribution diagram of FIG. 9 overlap with each other. As shown in FIG. 10, in this example, when light emitting diodes arranged in a horizontal direction of the screen are connected, light emitting diodes having substantially the same temperature are connected to each other.

Moreover, at the backlight unit 20, as shown in FIG. 10, there are provided temperature sensors 32 for detecting temperatures of the groups of respective light emitting diodes 30.

Figure 11:
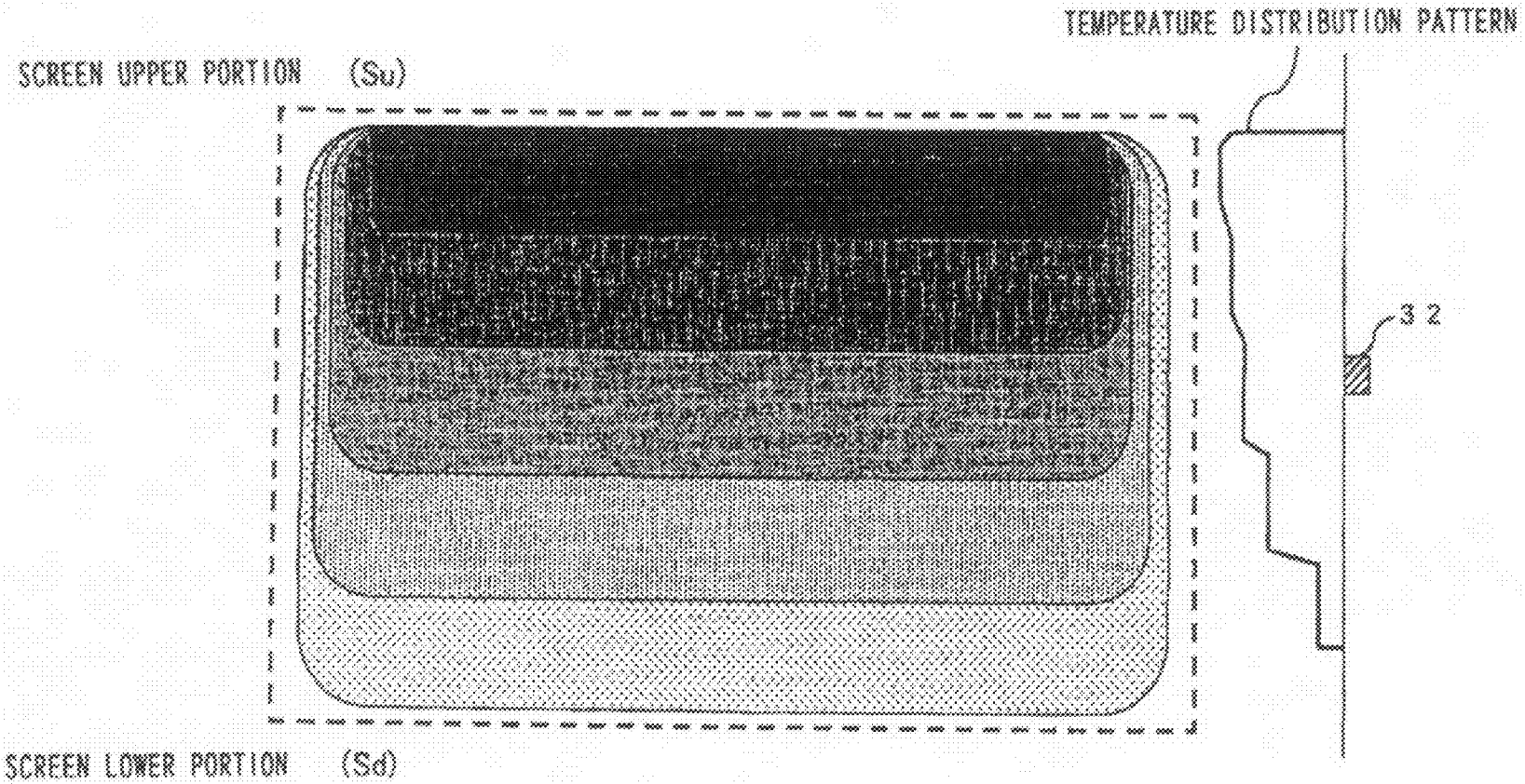
FIG. 11 is a view for explaining processing for estimating temperatures of respective positions from one temperature sensor and temperature distribution pattern.

As the temperature sensor 32, as shown in FIG. 10, there may be provided plural LEDs at respective vertical positions corresponding to the groups of light emitting diodes which are connected in series in a horizontal direction, or only one LED may be provided at one backlight unit 20. Moreover, as shown in FIG. 11, for example, the backlight unit 20 may be caused to be of the configuration in which one temperature sensor 32 and a memory within which temperature distribution pattern in the screen vertical direction is stored in advance, e.g., memory 49 which will be described later are provided at the screen center to estimate temperatures at respective positions in the screen vertical direction by making reference to the content from detection value of one temperature sensor 32. Temperature values detected by the temperature sensors 32 are delivered to the LED drive circuit 32 for driving corresponding group of light emitting diodes.

Further, at the backlight unit 20, as shown in FIG. 10, there are provided, e.g., light quantity or chromaticity sensors 33 (33R, 33G, 33B) for detecting light quantities or chromaticities of respective colors of R, G, B of the respective groups of light emitting diodes 30.

As shown in FIG. 10, plural light quantity or chromaticity sensors 33 (33R, 33G, 33B) are provided at respective vertical positions corresponding to the groups 30 of light emitting diodes which are connected in series in a horizontal direction. Moreover, there may be employed an optical system in which a diffusion plate for permitting the entire color mixture to be uniform, etc. is utilized to effectively perform color mixing of rays of light emitted of individual LEDs, and the like to allow the number of light quantity or chromaticity sensors 33 (33R, 33G, 33B) to be one.

It is to be noted that in the case where LEDs are used as the backlight light source for liquid crystal, there are instances where light quantity or chromaticity sensors 33 cannot be disposed in the vicinity of the groups of light emitting diodes 30 for the reason of the restriction of arrangement and shape. In the case where light quantity or chromaticity sensors 33 are disposed at a portion apart from the groups 30 of light emitting diodes, they detect, as weak light, rays of light which are emitted from the groups of light emitting diodes 30. In the case where the light quantity or chromaticity sensors 33 are disposed at a portion near from the groups of light emitting diodes 30, they detect, as strong light, rays of light which are emitted from the groups of light emitting diodes 30. In such a case, the characteristic of the light quantity or chromaticity sensor 33 is calculated by optical simulation or actual measurement by the reference light emitting diode, etc. to prepare the correction value data thereof as memory table in advance to correct sensed light quantity data on the basis of correction value data, thus making it possible to comply with such situation or inconvenience.

Then, the LED drive circuit 31 for driving groups of light emitting diodes 30 which are connected in series in a horizontal direction will be explained. In this case, the LED drive circuit 31 is provided within backlight drive control unit 180.

Figure 12:
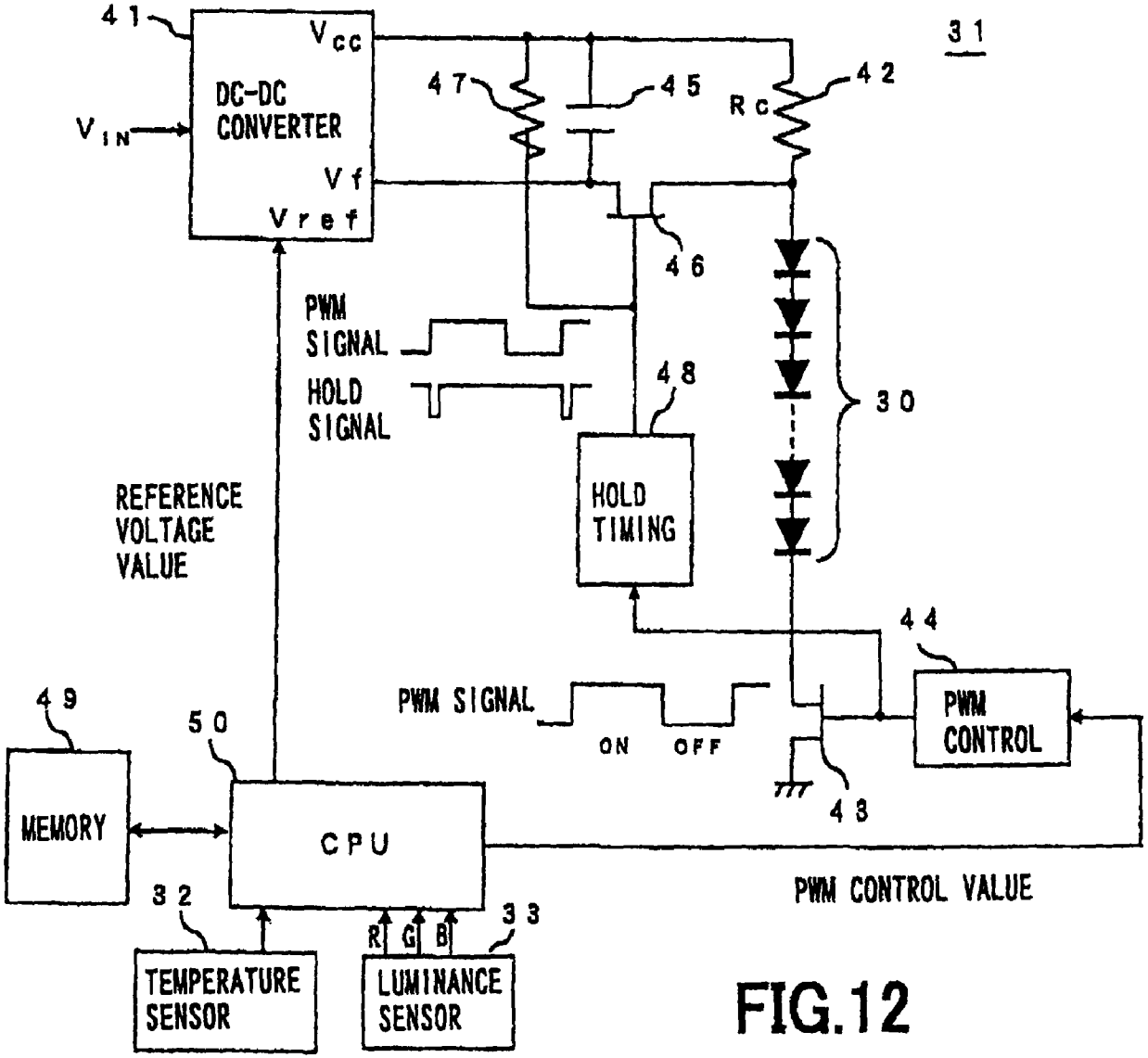
FIG. 12 is a block diagram showing drive circuit for driving light emitting diodes.

A circuit configuration example of the LED drive circuit 31 is shown in FIG. 12.

The LED drive circuit 31 comprises a DC-DC converter 41, a constant resistor (Rc) 42, a FET 43, a PWM control circuit 44, a capacitor 45, a FET 46 for sample hold, a resistor 47, a hold timing circuit 48, a memory 49, and a CPU (Central Processing Unit) 50.

The LED drive circuit 31 is supplied with detection output values of the temperature sensor or sensors 32, and the light quantity or chromaticity sensors 33 (33R, 33G, 33B).

The DC-DC converter 41 is supplied with DC voltage $V_{IN}$ generated from the light source 110 shown in FIG. 2 to perform switching operation of inputted DC power to generate a stabilized DC output voltage Vcc. The DC-DC converter 41 generates a stabilized output voltage Vcc so that potential difference between voltage inputted from feedback terminal Vf and output voltage Vcc becomes equal to reference voltage value (Vref). In this example, reference voltage value (Vref) is delivered from the CPU 50.

The anode side of the group of light emitting diodes 30 which are connected in series is connected to the output terminal for output voltage Vcc of the DC-DC converter 41 through constant resistor (Rc). Moreover, the anode side of the group of light emitting diodes 30 which are connected in series is connected to the feedback terminal of the DC-DC converter 41 through source-drain of the sample-hold FET 46. Further, the cathode side of the group of light emitting diodes 30 which are connected in series is connected to the ground through the portion (channel) between source and drain.

The gate of the FET 43 is supplied with PWM signal which has been generated from the PWM control circuit 44. When PWM signal is in ON state, the portion (channel) between the source and the drain of the FET 43 is turned ON. When the PWM signal is in OFF state, the portion (channel) between source and drain is tuned OFF. Accordingly, when the PWM signal is in ON state, the FET 43 allows current to flow in the groups of light emitting diodes 30. When the PWM signal is in OFF state, the FET 43 allows current flowing in the group of light emitting diodes 30 to be zero. Namely, when the PWM signal is in ON state, the FET 43 emits the group of light emitting diodes 30. When the PWM signal is in OFF state, the FET 43 stops emitting operation of light emission of the groups of light emitting diodes 30.

The PWM control circuit 44 generates a PWM signal which is binary signal in which duty ratio between ON time and OFF time is adjusted. The PWM control circuit 44 is supplied with a PWM control value from the CPU 50 to change duty ratio in accordance with the PWM control value.

The capacitor 45 is provided between the output terminal of the DC-DC converter 41 and the feedback terminal thereof. The resistor 47 is connected to the output terminal of the DC-DC converter 41 and the gate of the sample-hold FET 46.

The hold timing circuit 48 is supplied with a PWM signal to generate a hold signal which is turned OFF only for a predetermined time period at rising edge of the PWM signal and which is turned ON at other times.

The gate of the sample-hold FET 46 is supplied with a hold signal which has been outputted from the hold timing circuit 48. When the hold signal is in OFF state, the portion (channel) between the source and the drain of the sample hold FET 46 is turned ON. When the hold signal is in ON state, the portion (channel) between the source and the drain of the sample-hold FET 46 is turned OFF.

In the LED drive circuit 31 as stated above, current $I_{LED}$ is caused to flow in the group of light emitting diodes 30 only for a time period during which PWM signal generated from the PWM control circuit 44 is in ON state. Moreover, the capacitor 45, the sample-hold FET 46 and the resistor 47 constitute sample-hold circuit. The sample-hold circuit serves to sample, at the time when the PWM signal is in ON state, voltage value of the anode of the group of light emitting diodes 30, i.e., one end of the constant resistor 42 in which output voltage Vcc is not applied to deliver the voltage value thus sampled to the feedback terminal of the DC-DC converter 41. Since the DC-DC converter 41 stabilizes output voltage Vcc on the basis of voltage value inputted to the feedback terminal, crest (peak) value of current $I_{LED}$ flowing in the constant resistor Rc 42 and the group of light emitting diodes 30 becomes constant.

Accordingly, in the LED drive circuit 31, pulse drive operation corresponding to the PWM signal is performed in the state where crest (peak) value of current $I_{LED}$ flowing in the group 30 of light emitting diodes 30 is caused to be constant.

The CPU 50 serves to adjust current quantities flowing in the groups of light emitting diodes 30, on the basis of both detection signals of the temperature sensor or sensors 32 and the light quantity or chromaticity sensors 33 (33R, 33G, 33B), so that color tone (color temperature and chromaticity) and luminance of white light emitted from the backlight unit 20 become constant.

Adjustment of current values flowing in the group of light emitting diodes 30 may be performed by changing PWM control value to adjust duty of current flowing in the group of light emitting diodes 30, may be performed by changing reference voltage value (Vref) delivered to the DC-DC converter 41 to adjust crest (peak) value of current flowing in the group of light emitting diodes 30, or may be performed by combination of these adjustment methods.

As stated above, the CPU 50 performs feedback control of intensity of rays of light emission of the group of light emitting diodes 30 on the basis of both detection signals of the temperature sensor or sensors 32 and light quantity or chromaticity sensors 33 (33R, 33G, 33B), thus making it possible to generate white light having uniform chromaticity and luminance within the image.

Here, the reason why detection output value of the temperature sensor 32 is used for the purpose of controlling the intensity of light emission of the light emitting diode will be explained.

First, the temperature characteristic of the LED element will be explained with reference to FIGS. 13 to 15.

Figure 13:
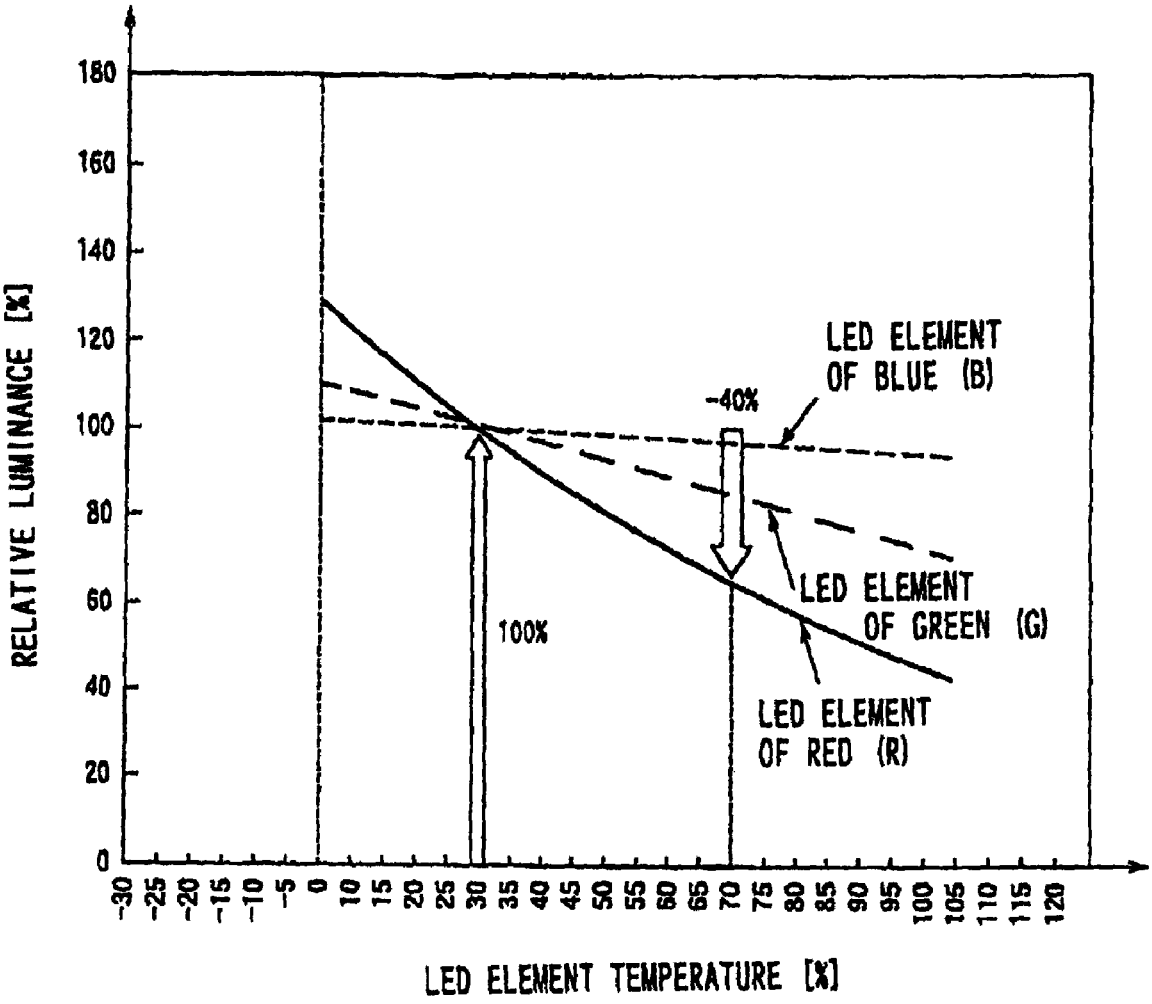
FIG. 13 is a view used for explanation with respect to temperature characteristic of rays of light which are emitted from respective LED elements.

FIG. 13 is a view showing relative luminance values of respective LED elements of red (R), green (G) and blue (B). In the graph of FIG. 13, LED element temperature is indicated in the x-axis direction, relative luminance is indicated in the y-axis direction, and the point of element temperature 25° C. is caused to be relative luminance 100%.

The LED element of red (R) has the semiconductor layered structure of four element system of AlInGaP. Since the band gap energy is low, carriers contribution to light emission decrease at the time of high temperature. Thus, light quantity emitted is lowered. As a result, in the state of about 70° C. which is general as running (operating) temperature of LED element, luminance value is lowered down to about 60% when 25° C. is set as normal temperature. Moreover, in the LED element of red (R), change of luminance value with respect to temperature is large as compared to other colors.

On the other hand, in the LED element of green (G) and the LED element of blue (B) having the semiconductor layered structure of three element system of InGaN, those LED elements have wavelength shorter than that of the LED element of red (R) so that their colors become more violet. Accordingly, the band gap energy is large. Thus, these LED elements become difficult to undergo influence of temperature.

As stated above, it is understood that quantities of rays of light of LED elements are such that temperature characteristics differ every colors.

Figure 14:
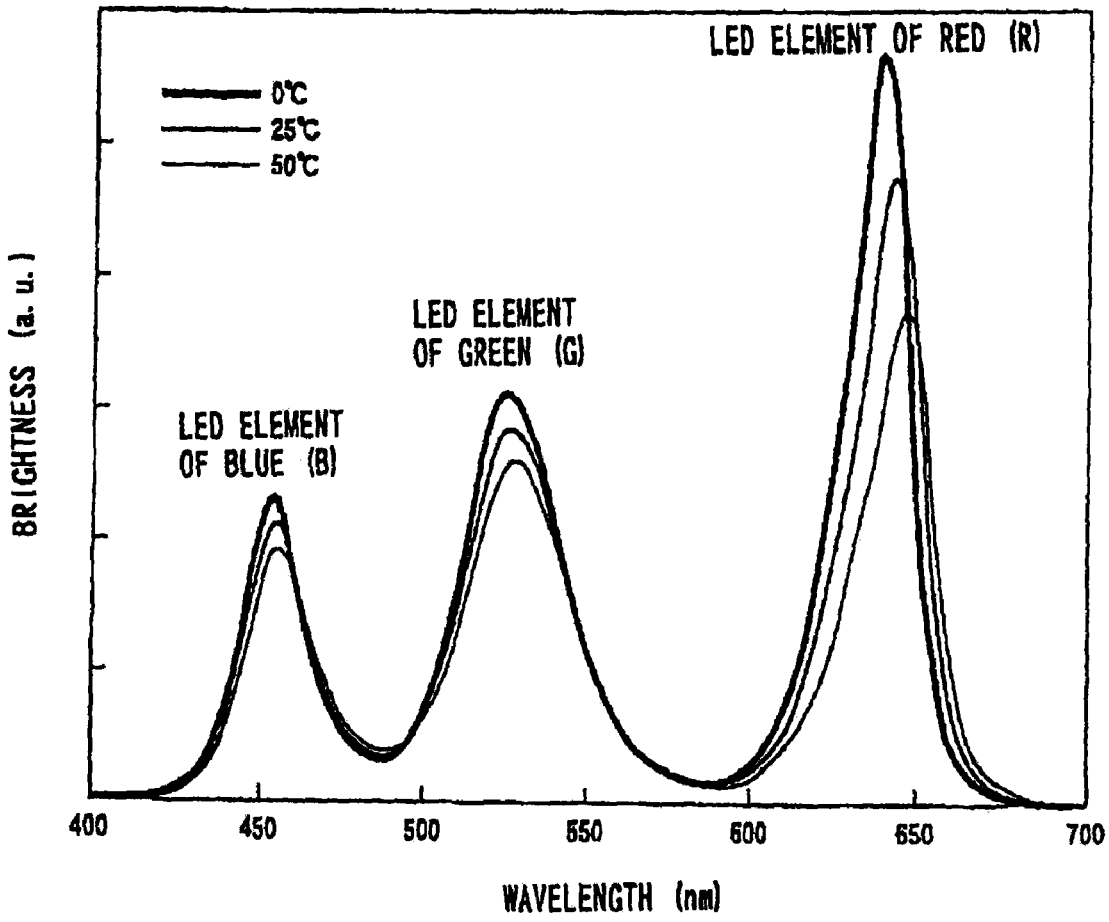
FIG. 14 is a characteristic diagram showing change of wavelength with respect to temperature change of respective LED elements and brightness characteristic followed thereby.

FIG. 14 is a graph showing brightness with respect to light emission wavelengths of respective LED elements of red (R), green (G) and blue (B). Graphs with respect to respective cases where temperature is 0° C., 25° C. and 50° C. are shown in FIG. 14. In this case, in the graph of FIG. 14, light emission wavelength is indicated in the x-axis direction, and light emission output (brightness) is indicated in the y-axis direction.

As understood with reference to FIG. 14, in respective LED elements, not only light emission quantity with respect to temperature (area of the portion encompassed by curve) changes, but also wavelength shifts toward long wavelength side according as temperature increases. Particularly, in the LED element of red (R), wavelength corresponding mountain-shaped summit point (peak) (peak wavelength) shifts toward long wavelength side according as temperature increases.

From the above-mentioned. FIGS. 13 and 14, it is understood that temperature characteristics of the LED elements greatly change depending upon respective colors. In concrete terms, it is understood that the LED element of blue (B) has the characteristic that there is hardly change in luminance value with respect to temperature change and change of wavelength with respect to temperature change is small, and the LED element of red (R) has the characteristic, on the other hand, that luminance value with respect to temperature change is large and change of wavelength with respect to temperature change is also large.

Figure 15:
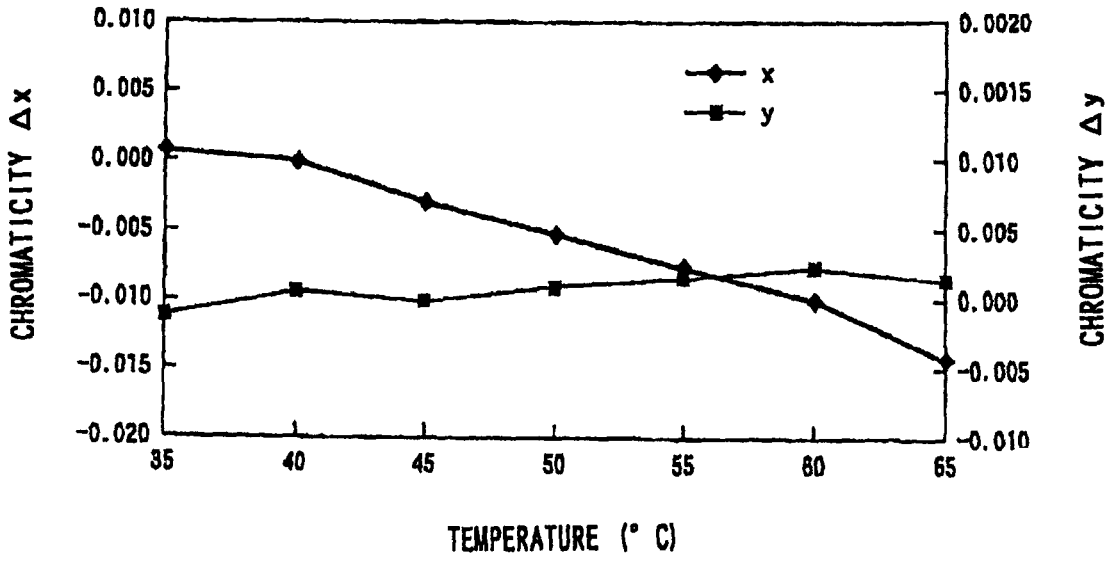
FIG. 15 is a view showing deviation of white chromaticity when rays of light which are emitted from respective LED elements are combined to optically perform synthetic additive color mixture at the backlight unit to obtain white light.

FIG. 15 shows temperature deviation of white chromaticity (CIE chromaticity coordinate display (x, y)) when rays of light emitted from LED element of red (R), LED element of green (G) and LED element of blue (B) which have the above-described characteristic are combined to optically perform synthetic additive color mixture at the backlight unit 20 to obtain white light. In this case, the characteristic shown in FIG. 15 is measured in the state where feedback control of temperature and light quantity based on chromaticity sensor is stopped. As shown in FIG. 15, when temperature rises from 35° C. to 60° C., chromaticity of white light has the deviation that deviation of Y (Δy value) becomes equal to +0.0025 and deviation of X (Δx value) becomes equal to −0.015. It is understood that the chromaticity of white color is in correspondence with the tendency where wavelength corresponding to mountain-shaped summit point (peak) (peak wavelength) shifts towards long wavelength side according as temperature rises in the characteristic with respect to temperature change of LED element of red (R) shown in FIG. 14.

The LED elements have temperature characteristic as stated above.

Such LED elements have large temperature dependency and have their characteristics varying depending upon colors. For this reason, the CPU 50 is required to perform a control also by using the temperature sensor 32 in order to allow color tone (color temperature and chromaticity) of white light emitted from the backlight unit 20 to be constant.

Further, in order to allow color tone (color temperature and chromaticity) of white light emitted from the backlight unit 20 to be constant, the CPU 50 is required to detect, by light quantity sensors, respective light emission quantities of respective colors of red (R), green (G) and blue (B) to synthetically control light emission quantities of red (R), green (G) and blue (B). Namely, there is not employed an approach to perform feedback control of light emission quantity of red (R) by making reference to only light quantity sensor output for red (R), but it is required to perform feedback control of light emission quantity of red (R) by making reference to light quantity sensor outputs of all colors (red (R), green (G) and blue (B)) also including other colors.

For this reason, the CPU 50 performs operation (calculation) on the basis of matrix operational expression having three rows and three columns as indicated by the following formula (1) to synthetically adjust light emission quantities of LED elements of respective colors (R, G, B).

[1]

$$\begin{pmatrix} X \\ Y \\ Z \end{pmatrix} = \begin{pmatrix} m_{11} & m_{12} & m_{13} \\ m_{21} & m_{22} & m_{23} \\ m_{31} & m_{32} & m_{33} \end{pmatrix} \begin{pmatrix} Lr \\ Lg \\ Lb \end{pmatrix} \quad (1)$$

Matrix $A$

In the formula (1), "X", "Y" and "Z" represent chromaticity coordinates of rays of light emitted from the backlight unit 20. Moreover, in the formula (1), "Lr" indicates detection output value of red component of the light quantity or chromaticity sensor 33, "Lg" indicates detection output value of green component of the light quantity or chromaticity sensor 33, and "Lb" indicates detection output value of blue component of the light quantity or chromaticity sensor 33.

Moreover, matrix A consisting of coefficients $m_{xy}$ of three rows×three columns which is preceding matrix of the right side of the formula (1) is matrix of coefficients multiplied by detection output values (Lr, Lg, Lb) of the light quantity or chromaticity sensor 33. (In this case, subscript x of m is 1, 2, 3 and indicates row number of coefficient corresponding thereto, and subscript y thereof is 1, 2, 3 and indicates column number of coefficient corresponding thereto). The matrix A should be expressed as constant when considered ideally. However, since LED elements of respective colors have temperature characteristic in practice as described above, the matrix A results in matrix obtained by multiplying matrix C represented by constant $j_{xy}$ of three rows×three columns and matrix B of function $k_{xy}(T)$ using, as parameter, temperature T of LED element for canceling the temperature characteristic.

[2]

$$\begin{pmatrix} m_{11} & m_{12} & m_{13} \\ m_{21} & m_{22} & m_{23} \\ m_{31} & m_{32} & m_{33} \end{pmatrix} = \begin{pmatrix} j_{11} & j_{12} & j_{13} \\ j_{21} & j_{22} & j_{23} \\ j_{31} & j_{32} & j_{33} \end{pmatrix} \begin{pmatrix} k_{11}(T) & k_{12}(T) & k_{13}(T) \\ k_{21}(T) & k_{22}(T) & k_{23}(T) \\ k_{31}(T) & k_{32}(T) & k_{33}(T) \end{pmatrix} \quad (2)$$

Matrix $C$ Matrix $B$

Namely, the CPU 50 performs, on the basis of the formula (1), by using detection output (T) of temperature sensor 32 along with detection outputs (Lr, Lg, Lb) of the light quantity or chromaticity sensor 33, a feedback control such that color tone (color temperature and chromaticity) of white light becomes constant.

In this example, function $k_{xy}(T)$ values which are components of the matrix B and coefficient $j_{xy}$ values which are components of the matrix C are calculated in advance by experiment or measurement before shipping or forwarding from factory, and are stored in memory 49 which is non-volatile memory.

The practical operation of the CPU 50 for performing the operation (calculation) and the control which have been stated above is as follows.

During the operation of the backlight unit 20, the CPU 50 performs, at a suitable time period (e.g., every predetermined time period, or at all times) an adjustment control of chromaticity and luminance of the backlight unit 20.

When the CPU 50 starts the adjustment control of chromaticity and luminance of the backlight unit 20, it reads out outputs of the temperature sensor or sensors 32 and the light quantity or chromaticity sensors 33, and calls (reads out) the function $k_{xy}$ and the coefficient $j_{xy}$ from the memory 49.

The CPU 50 is operative to substitute temperature or temperatures which has or have been detected by the temperature sensor or sensors 32 into T of the above-mentioned formulas (1) and (2), and to substitute detection values of the light quantity or chromaticity sensors 33 into Lr, Lg, Lb of the above-mentioned formulas (1) and (2) to calculate chromaticities (X, Y, Z) of respective colors of the backlight unit 20.

Further, the CPU 50 adjusts current value (PWM duty or crest value) caused to flow in LED elements of respective colors so that the chromaticities (X, Y, Z) thus calculated become equal to values stored in the memory 49, etc. in which specific set values, e.g., ideal values are set before shipping or forwarding from factory.

Thus, the CPU 50 permits color tone (color temperature and chromaticity) of white light emitted from the backlight unit 20 to be constant at all times.

Figure 16A:
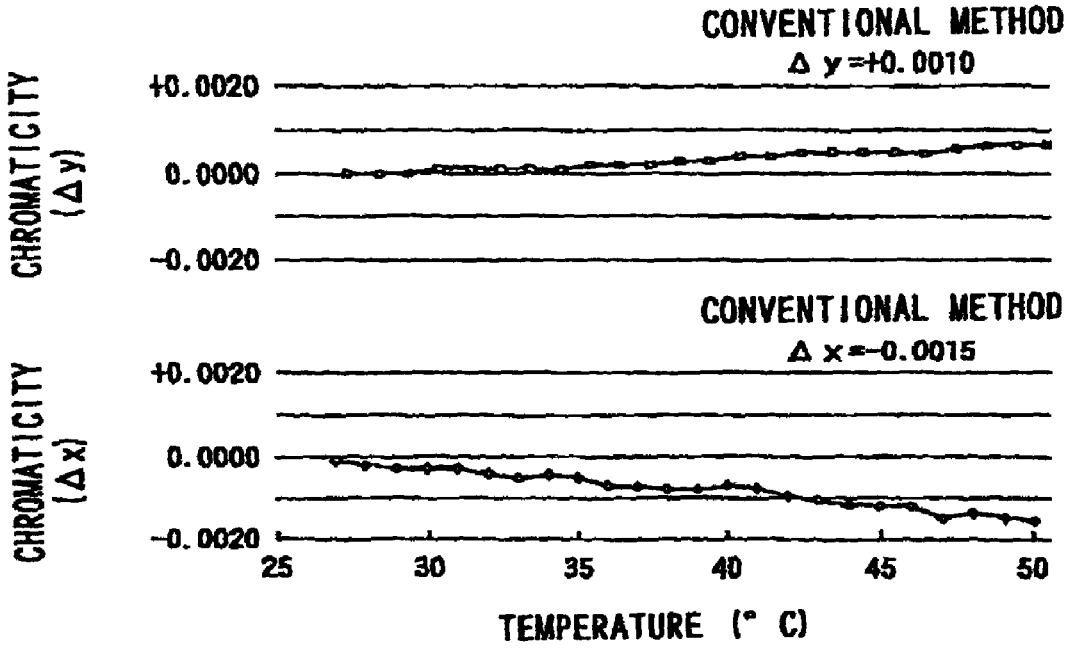
FIGS. 16A and 16B are views showing data obtained by optically performing optical output balance.

FIG. 16A is a view showing temperature deviation of chromaticity (CIE chromaticity coordinate display (x, y)) of white light emitted from the backlight unit 20 in the case where chromaticity control is performed only by the light quantity or chromaticity sensor 33 without performing feedback control by the temperature sensor 32 (the case of the conventional method). Moreover, FIG. 16B is a view showing temperature deviation of chromaticity (CIE chromaticity coordinate display (x, y)) of white light emitted from the backlight unit 20 in the case where feedback control by both the temperature sensor 32 and the light quantity or chromaticity sensor 33 is performed to perform chromaticity control (the case of the method of the present invention).

As shown in FIG. 16A, in the case where chromaticity control is performed only by the light quantity or chromaticity sensor 33, Δy value is +0.0010 and Δx value is −0.0015 as deviation within the range from 25° C. to 50°. It is understood that this characteristic is improved by ⅕ in terms of Δy value and by 1/10 in terms of Δx value as compared to the characteristic shown in FIG. 15.

Figure 16B:
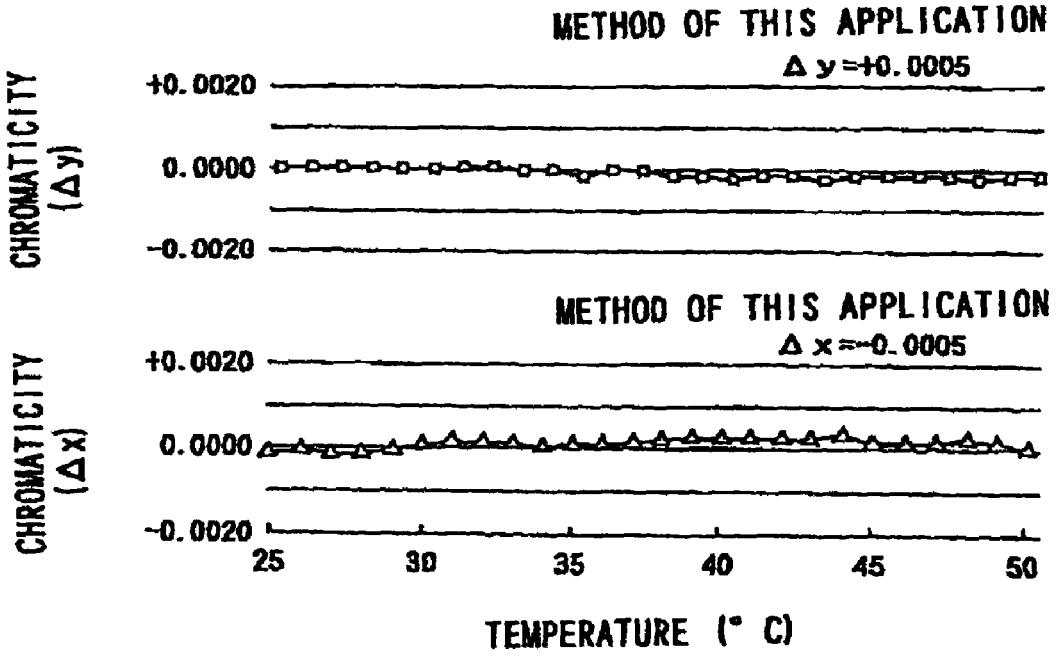

Further, in the case where feedback control by both the temperature sensor 32 and the light quantity or chromaticity sensor 33 is performed to perform chromaticity control as shown in FIG. 16B, Δy value is +0.0005 and Δx value is −0.0005 as deviation within the range from 25° C. to 50° C. It is understood that this characteristic is improved by ½ in terms of Δy value and by ⅓ in terms of Δx value as compared to the characteristic shown in FIG. 15 so that further characteristic improvement is performed.

As stated above, in accordance with the backlight unit 20 to which the present invention is applied, since color tone (color temperature and chromaticity) and luminance of white light to be emitted are caused to be constant on the basis of both detection signals of the temperature sensor or sensors 32 and the light quantity or chromaticity sensors 33 (33R, 33G, 33B), it is possible to emit rays of light of stable color tone with high accuracy.

Figure 17:
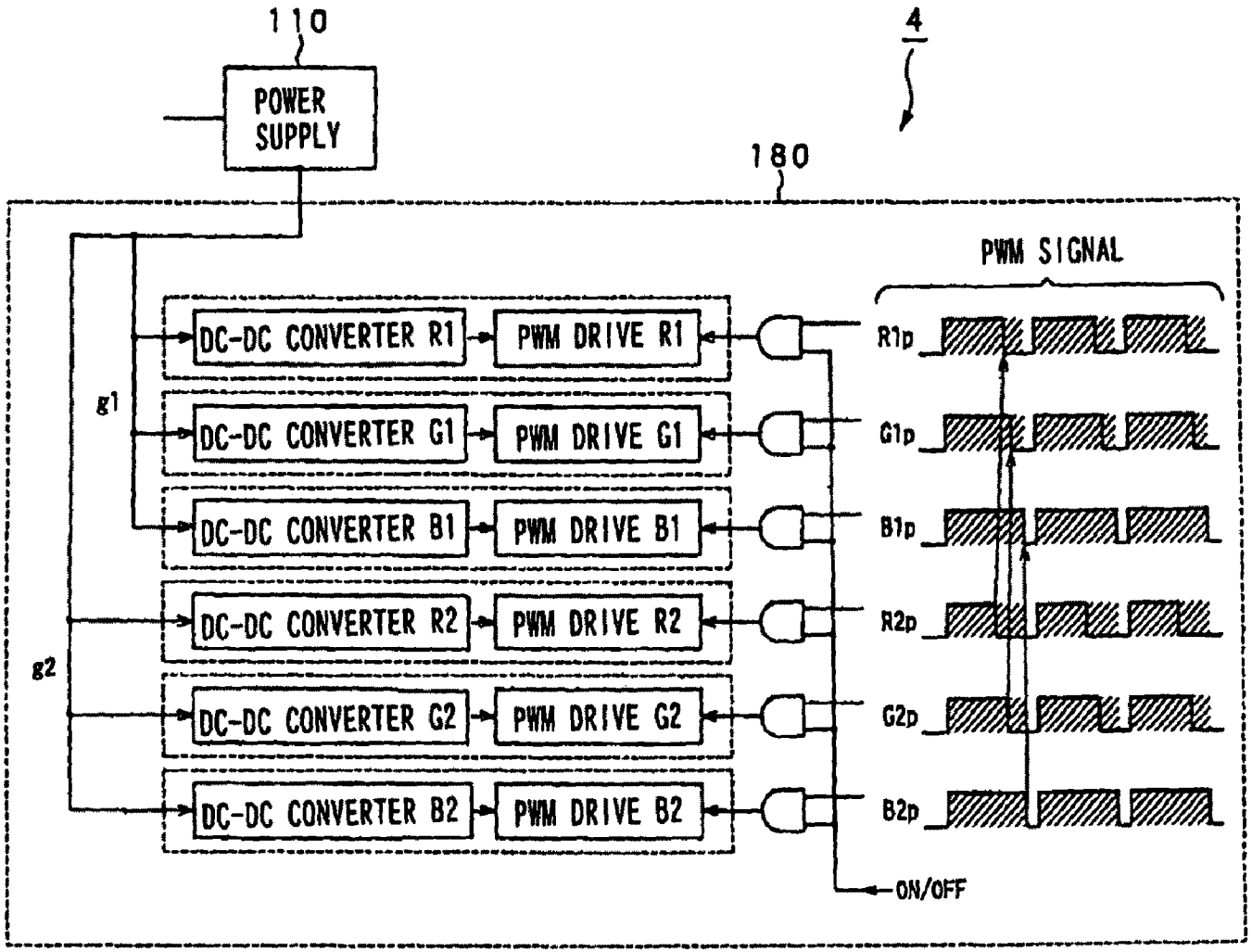
FIG. 17 is a block diagram showing the configuration of the backlight unit.

Then, the configuration of the backlight drive control unit 180 will be explained. As shown in FIG. 17, the backlight drive control unit 180 comprises the above-described plural LED drive circuits 31 supplied with voltage from power supply 110 for converting AC voltage into DC voltage to drive the groups of light emitting diodes 30.

In FIG. 17, the group of g1 indicates group of the uppermost row composed of group of light emitting diodes 30 of red (R1), group of light emitting diodes 30 of green (G1) and group of light emitting diodes of blue (B1). The group of g2 indicates the group of row located below by one row relative to the group g1 composed of group of light emitting diodes 30 of red (R2), group of light emitting diodes 30 of green (G2) and group of light emitting diodes 30 of blue (B2). In addition, FIG. 14 shows, in a model form, difference between drive widths when PWM signal is delivered to the group of light emitting diodes 30 of respective rows.

Here, the PWM drive operation with respect to the group of light emitting diodes 30 which is performed by the backlight drive control unit 180 will be explained.

First, attention is drawn to the LED element of blue (B). Since the LED element of blue (B) has difficulty in luminous efficacy, ON time period of the PWM signal is caused to be larger than light emission period of the LED element of red (R) and LED element of green (G) to complement or compensate light quantity of shortage. Moreover, there hardly exists difference between drive width of PWM signal of B1*p* of the g1 row and drive width of PWM signal of B2*p* of the g2 row. This is because since g1 row is located above the display relative to g2 row so that it has high temperature, but LED element to which attention is drawn is LED element of blue (B) having less light emission change by temperature dependency, it is unnecessary to allow drive width to be varied.

Then, attention is drawn to LED element of red (R). Since the LED element of red (R) has good light luminous efficacy, ON time period of the PWM signal is shortened as compared to the LED element of blue (B). Moreover, difference k between drive widths of PWM signal of R1*p* of g1 row and PWM signal of R2*p* of g2 row is large. This is because since g1 row is located above the display relative to g2 row so that temperature is high and LED element to which attention is drawn is LED element of red (R) having large light emission quantity change by temperature dependency, it is necessary to allow drive width to be varied. The backlight drive control unit 180 performs drive operation such that pulse width of the PWM signal becomes large, in order to realize light quantity balance with respect to groups of other rows, at g1 row where temperature is high.

The backlight drive control unit 180 is adapted so that difference of ON time period of PWM signal is used as a technique for changing light emission quantity in order to allow temperature distribution of the display to be uniform, thus making it possible to ensure uniformity of temperature characteristic within the display.

Then, the operation for adjusting adjustment resolutions of respective colors will be explained below.

Figures 18A, 18B, 18C:
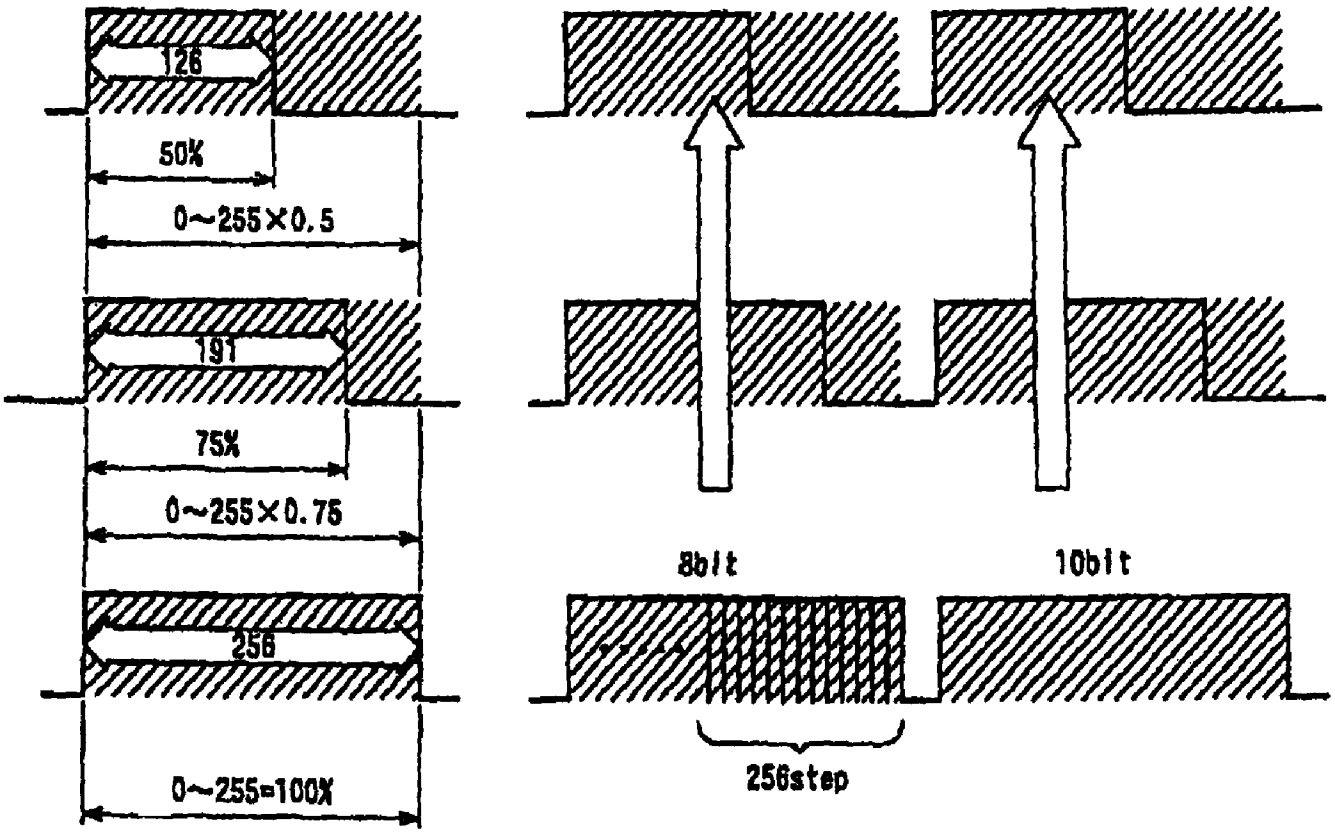
FIGS. 18A, 18B and 18C are views used for explanation with respect to resolution of PWM signal.

FIG. 18 is a waveform diagram showing resolution of PWM signal. FIG. 18A shows waveform diagram of PWM signal delivered to the group of light emitting diodes 30 of red (R), FIG. 18B shows a waveform diagram of PWM signal delivered to the group of light emitting diodes 30 of green (G), and FIG. 18(C) shows a waveform diagram of PWM signal delivered to the group of light emitting diodes 30 of blue (B).

As the result of the fact that mixture ratio of rays of light emitted from the LED element of red (R), rays of light emitted from the LED element of green (G) and rays of light emitted from the LED element of blue (B) is adjusted in order to obtain a predetermined white light, a predetermined white light can be obtained, as shown in FIG. 18, at the time of mixture ratio where pulse width of PWM signal delivered to the group of light emitting diodes 30 of blue (B) is 256 (100%), pulse width of PWM signal delivered to the group of light emitting diodes 30 of green (G) is 191 (about 75%), and pulse width of PWM signal of the group of light emitting diodes 30 of red (R) is 126 (50%).

Moreover, in the above-described example, in the case where adjustment width of pulse width of PWM signal delivered to respective groups of light emitting diodes 30 is set to 8 bits, the degree of freedom of pulse width of PWM signal delivered to the group of light emitting diodes 30 of blue (B) can be adjusted by 1/256 Step as shown in FIG. 18. However, the degree of freedom of adjustment width of pulse width of PWM signal delivered to the group of light emitting diodes 30 of red (R) can be only adjusted by 1/126 Step which is about one half thereof. Moreover, there takes place the inconvenience where 1 Step of pulse width of PWM signal delivered to the group of light emitting diodes 30 of blue (B) becomes equal to a value which is twice larger than 1 Step of pulse width of PWM signal delivered to the group of light emitting diodes 30 of red (R). This is inconvenient from a viewpoint of insurance of adjustment accuracy.

In order to avoid such inconvenience, it is necessary to increase resolution of adjustment width. For example, there is a technique of allowing adjustment width of pulse width of PWM signal delivered to the group of light emitting diodes of blue (B) 30 to be 10 bits. However, there is a difference between adjustment steps every respective groups of light emitting diodes 30. Since improvement is not performed in principle, when difference of ON time period of PWM signal reaches 50%, adjustment width of pulse width of PWM signal delivered to the group of light emitting diodes 30 of red (R) would be deteriorated by value corresponding to 1 bit. In addition, when the adjustment resolution becomes equal to 10 bits or more, converter for performing processing, etc. becomes expensive so that the cost of the device itself is increased.

Figures 19A, 19B, 19C:
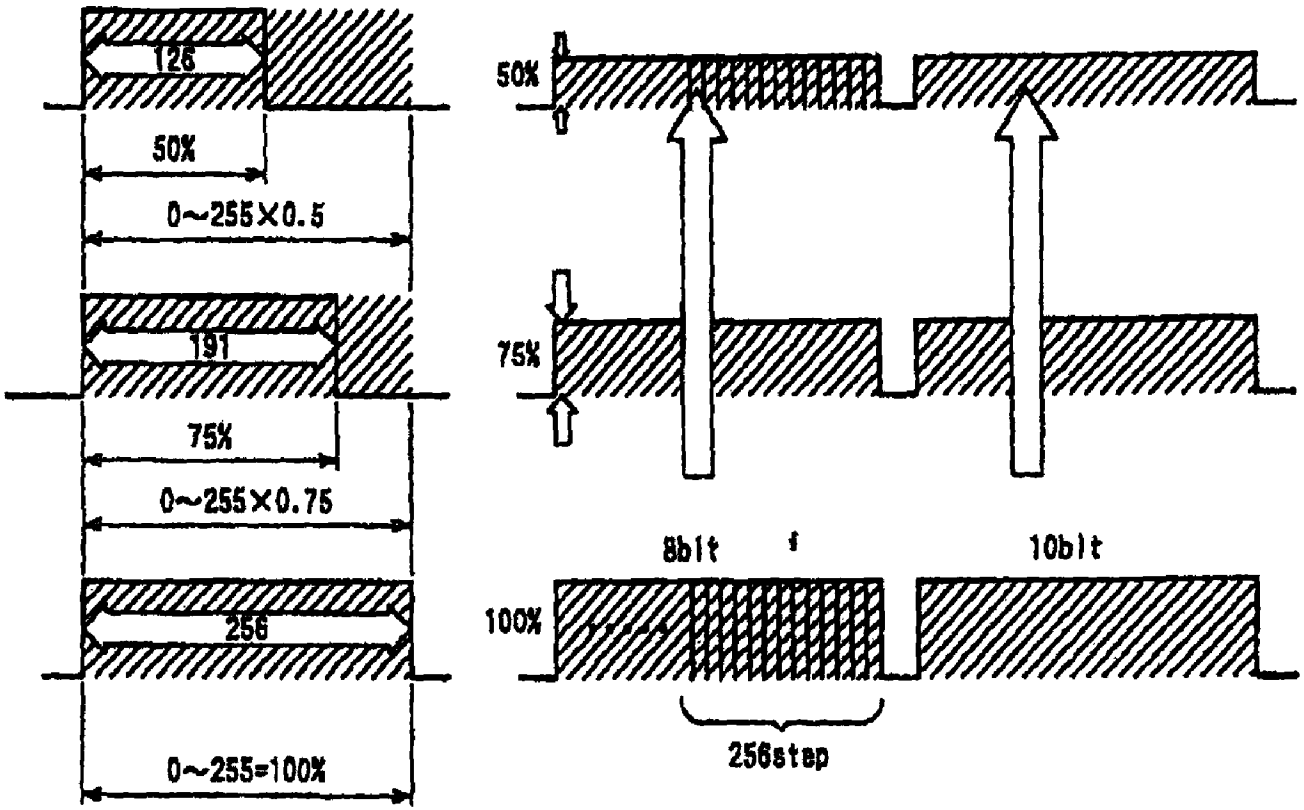
FIGS. 19A, 19B and 19C are views showing waveforms of PWM signals delivered to the groups of LED elements of respective colors.

In view of the above, as shown in FIG. 19, the backlight drive control unit 180 adjusts crest (peak) value of a signal (constant current value ILED) delivered from the DC-DC converter to the respective groups of light emitting diodes 30 so that adjustment widths of PWM signals delivered to respective groups of light emitting diodes 30 are substantially uniform (e.g., 8 bits). The waveform diagram of PWM signal delivered to the group of light emitting diodes 30 of red (R) is shown in FIG. 19A, the waveform diagram of PWM signal delivered to the group of light emitting diodes 30 of green (G) is shown in FIG. 19B, and the waveform diagram of PWM signal delivered to the group of light emitting diodes 30 of blue (B) is shown in FIG. 19C.

The backlight drive control unit 180 performs PAM (Pulse Amplitude Modulation) of signals delivered from, e.g., DC-DC converter to respective groups of light emitting diodes 30 to adjust crest (peak) value of constant current value ILED delivered to respective groups of light emitting diodes 30. Accordingly, the backlight drive control unit 180 performs adjustments in time direction and in direction of crest value with respect to signals to be delivered to respective groups of light emitting diodes 30 to ensure accuracy at the time of adjustment, thus making it possible to maintain balance of adjustment accuracy of the respective groups of light emitting diodes 30.

Figures 20A, 20B, 20C:
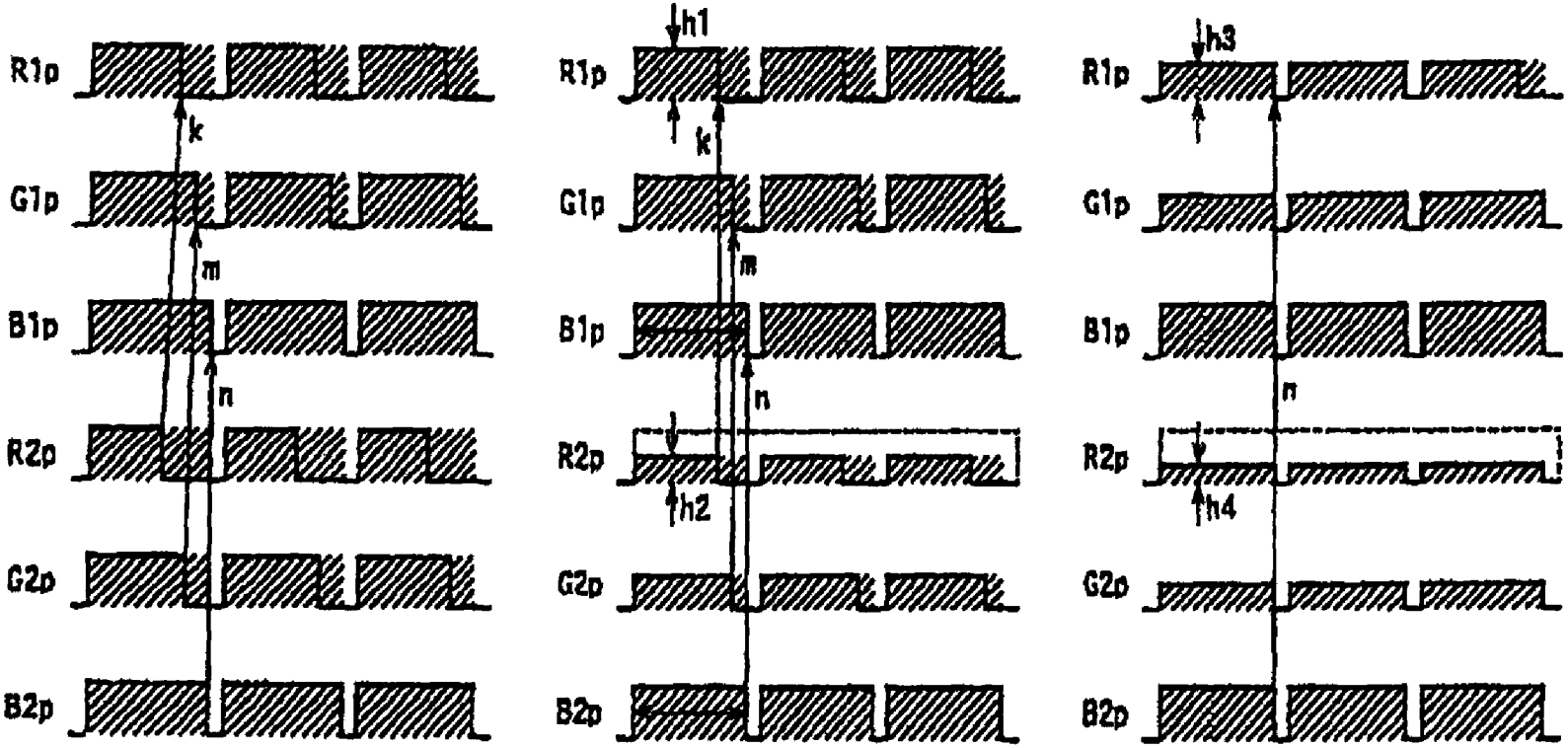
FIGS. 20A, 20B and 20C are views showing practical examples of waveforms of PWM signals delivered to the groups of LED elements of respective colors.

Here, an actual example of a signal waveform when signals delivered to the groups of light emitting diodes 30 are adjusted is shown below. FIG. 20A shows signal waveform in the case where a signal in time direction is modulated (PWM is performed), and a signal in amplitude direction is not changed (fixed), i.e., peak current of LED element is not changed. Moreover, FIG. 20C shows a signal waveform in the case where signal in the time direction (in the PWM direction) is fixed, and signal only in amplitude direction is modulated. Further, FIG. 20B shows a signal waveform in the case where a signal in time direction is modulated and a signal in amplitude direction is also modulated.

It is to be noted that in the case where, e.g., luminance may be intensionally adjusted by white balance, etc., the backlight drive control unit 180 performs modulation in a time direction (PWM), and modulation in an amplitude direction (PAM) may be performed for correction of light emission output balance by temperature distribution of display.

In adjusting light emitting operation of the groups of light emitting diodes 30 constituting the backlight unit 2, the backlight drive control unit 180 according to the invention of this Application constituted in this way performs adjustments in the amplitude direction and in the time direction so that resolutions of adjustment become uniform in all of the groups of light emitting diodes 30 of respective colors.

In addition, since the backlight drive control unit 180 according to the invention of this Application suitably detects temperature distribution extending from the upper portion of the display toward the lower portion thereof to perform adjustment in the amplitude direction on the basis of the detection results to perform peak control of current values delivered to the groups of light emitting diodes 30, it is possible to eliminate display unevenness by temperature distribution of the display.

It is to be noted that the present invention has been described in accordance with preferred embodiments thereof illustrated in the accompanying drawings and described in detail, it should be understood by those ordinarily skilled in the art that the invention is not limited to embodiments, but various modifications, alternative constructions or equivalents can be implemented without departing from the scope and spirit of the present invention as set forth and defined by appended claims.

The invention claimed is:

1. A drive apparatus for a backlight unit comprised of groups of LED (Light Emitting Diode) elements, each of the groups including a plurality of LED elements, the drive apparatus comprising:

signal generating means for generating a signal having an arbitrary amplitude;

adjustment means for adjusting light emission quantities of the groups based on the generated signal;

voltage applying means for applying a predetermined voltage to the groups;

light emission quantity detecting means for detecting quantities of light emitted from the groups;

temperature detecting means for detecting temperatures of the groups;

control means for controlling the signal generating means based on the detected light emission quantities and the detected temperatures; and selector means for selecting at least one of the groups based on the detected temperatures, wherein the adjustment means adjusts the light emission quantities of the selected at least one of the groups based on the generated signal.

2. The drive apparatus as set forth in claim 1, wherein the generated signal is a PWM (Pulse Width Modulation) signal.

3. The drive apparatus as set forth in claim 1, further comprising:

amplitude adjustment means for adjusting the amplitude of a constant current value based on the detected temperatures, and delivering the constant current value to the voltage applying means, wherein the voltage applying means varies the voltage applied to the groups based on the constant current value.

4. The drive apparatus as set forth in claim 1, further comprising:

a memory that stores correction data for correcting the detected light emission quantities based on where the LED elements are disposed, wherein the control means corrects the detected light emission quantities based on the correction data, and controls the signal generating means based on the corrected detected light emission quantities and the detected temperatures.

5. The drive apparatus as set forth in claim 1, further comprising:

a memory table that stores correction value data for correcting the light emission quantities based on where the groups are disposed relative to the light emission detecting means, the light emitted from groups further from the light emission detecting means being designated as weaker light, and the light emitted from groups nearer to the light emission detecting means being designated as stronger light, wherein the control means corrects the detected light emission quantities based on the correction value data, and controls the signal generating means based on the corrected detected light emission quantities and the detected temperatures.

6. A drive method for a backlight unit comprised of groups of LED (Light Emitting Diode) elements, each of the groups including a plurality of LED elements, the drive method comprising:

a voltage application step of applying a predetermined voltage to the groups;

a light emission quantity detection step of detecting quantities of light emitted from the groups;

a temperature detection step of detecting temperatures of the groups;

a signal generation step of generating a signal having an arbitrary amplitude based on the detected light emission quantities and the detected temperatures;

an adjustment step of adjusting light emission quantities of the groups based on the generated signal; and a selection step of selecting at least one of the groups based on the detected temperatures, wherein the adjustment step is adapted to adjust the light emission quantities of the selected at least one of the groups based on the generated signal.

7. The drive method as set forth in claim 6, wherein the signal generation step is adapted to generate the generated signal as a PWM (Pulse Width Modulation) signal.

8. The drive method as set forth in claim 6, further comprising:

an amplitude adjustment step of adjusting the amplitude of a constant current value based on the detected temperatures, wherein the voltage application step is adapted to vary the voltage applied to the groups based on the constant current value.

9. The drive method as set forth in claim 6, further comprising:

a correction step of correcting the detected light emission quantities based on where the LED are disposed, wherein the signal generation step is adapted to generate the generated signal based on the corrected detected light emission quantities and the detected temperatures.

10. The drive method as set forth in claim 6, wherein the light emission quantity detection step includes detecting, with sensors, the quantities of light emitted from the groups, and the drive method further comprises:

a correction step of correcting the detected light emission quantities based on correction value data stored in a memory table, the correction value data corresponding to the relative positions of the sensors and the groups, the light emitted from groups further from the sensors being designated as weaker light, and the light emitted from groups nearer to the sensors being designated as stronger light, wherein the signal generation step is adapted to generate the generated signal based on the corrected detected light emission quantities and the detected temperatures.

* * * * *